US010790596B2

(12) United States Patent
Cheng et al.

(10) Patent No.: US 10,790,596 B2
(45) Date of Patent: Sep. 29, 2020

(54) SMART ANTENNA ASSEMBLY

(71) Applicant: WISTRON NEWEB CORPORATION, Hsinchu (TW)

(72) Inventors: Ching-Lun Cheng, Hsinchu (TW); Tsun-Che Huang, Hsinchu (TW); Cheng-Geng Jan, Hsinchu (TW); Kuang-Yuan Ku, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 100 days.

(21) Appl. No.: 16/231,474

(22) Filed: Dec. 22, 2018

(65) Prior Publication Data

US 2019/0280394 A1 Sep. 12, 2019

(30) Foreign Application Priority Data

Mar. 9, 2018 (TW) ..... 107108094 A

(51) Int. Cl.

| | |
|---|---|
| ***H01Q 21/24*** | (2006.01) |
| ***H01Q 3/44*** | (2006.01) |
| ***H01Q 21/06*** | (2006.01) |
| ***H01Q 21/28*** | (2006.01) |
| ***H01Q 15/14*** | (2006.01) |

(Continued)

(52) U.S. Cl.

CPC ..... *H01Q 21/245* (2013.01); *H01Q 3/44* (2013.01); *H01Q 9/065* (2013.01); *H01Q 15/14* (2013.01); *H01Q 21/062* (2013.01); *H01Q 21/24* (2013.01); *H01Q 21/28* (2013.01); *H01Q 1/2291* (2013.01); *H01Q 19/30* (2013.01)

(58) Field of Classification Search

CPC ..... H01Q 3/44; H01Q 9/065; H01Q 21/062; H01Q 21/245

See application file for complete search history.

(56) References Cited

U.S. PATENT DOCUMENTS 6,876,331 B2 * 4/2005 Chiang ..... H01Q 1/242 343/702
7,477,204 B2 * 1/2009 Lin ..... H01Q 3/242 343/795

(Continued)

FOREIGN PATENT DOCUMENTS

CN 104660309 A 5/2015

*Primary Examiner* — Ab Salam Alkassim, Jr.
(74) *Attorney, Agent, or Firm* — McClure, Qualey & Rodack, LLP

(57) ABSTRACT

A smart antenna assembly includes a first smart antenna device including a first polarization antenna, a second polarization antenna, a first switch unit, a first control terminal and a second control terminal. The first polarization antenna includes a first antenna, a first reflection element and a second reflection element. The second polarization antenna includes a second antenna, a third reflection element and a fourth reflection element. The first switch unit includes a first switch element electrically connected with the first reflection element, a second switch element electrically connected with the second reflection element, a third switch element electrically connected with the third reflection element, and a fourth switch element electrically connected with the fourth reflection element. The first control terminal is used to turn on the first and third switch elements. The second control terminal is used to turn on the second and fourth switch elements.

11 Claims, 13 Drawing Sheets

(51) Int. Cl.

| | |
|---|---|
| ***H01Q 9/06*** | (2006.01) |
| *H01Q 1/22* | (2006.01) |
| *H01Q 19/30* | (2006.01) |

(56) References Cited

U.S. PATENT DOCUMENTS 7,489,948 B2 * 2/2009 Taromaru ..... H04N 5/46 455/562.1
7,619,582 B2 * 11/2009 Chung ..... H01Q 1/2291 343/833
8,098,199 B2 * 1/2012 Shinkai ..... H01Q 1/2291 342/374
8,717,249 B2 * 5/2014 Noguchi ..... H01Q 3/44 343/833
8,797,224 B2 * 8/2014 Shinkai ..... H01Q 3/44 343/818
9,634,401 B2 * 4/2017 Belmkaddem ..... H01Q 21/00
10,135,119 B2 * 11/2018 Ku ..... H01Q 15/14
2005/0062667 A1 * 3/2005 Shirosaka ..... H01Q 3/2605 343/794
2006/0044205 A1 * 3/2006 Lynch ..... H01Q 3/44 343/833
2007/0001924 A1 * 1/2007 Hirabayashi ..... H01Q 19/32 343/893
2007/0030210 A1 * 2/2007 Shibata ..... H01Q 19/32 343/893
2007/0103377 A1 * 5/2007 Abramov ..... H01Q 1/2258 343/818
2007/0229357 A1 * 10/2007 Zhang ..... H01Q 3/44 343/700 MS
2010/0231451 A1 * 9/2010 Noguchi ..... H01Q 1/28 342/367
2010/0231453 A1 * 9/2010 Shinkai ..... H01Q 9/285 342/368
2011/0193761 A1 * 8/2011 Shinkai ..... H01Q 9/16 343/817
2012/0027056 A1 * 2/2012 Shinkai ..... H01Q 3/44 375/219
2012/0075156 A1 * 3/2012 Noguchi ..... H01Q 3/44 343/837
2014/0118191 A1 * 5/2014 Smith ..... H01Q 19/30 342/372
2017/0033471 A1 * 2/2017 Huang ..... H01Q 9/26
2017/0062924 A1 * 3/2017 Lee ..... H01Q 19/28
2017/0222318 A1 * 8/2017 Li ..... H01Q 9/28
2017/0271748 A1 9/2017 Ku et al.
2019/0131720 A1 * 5/2019 Yu ..... H01Q 25/005
2019/0245278 A1 * 8/2019 Hsieh ..... H01Q 21/205

* cited by examiner

SMART ANTENNA ASSEMBLY

FIELD OF THE PRESENT DISCLOSURE

The present disclosure relates to an antenna, and more particularly to a smart antenna assembly.

CROSS-REFERENCE TO RELATED PATENT APPLICATION

This application claims the benefit of priority to Taiwan Patent Application No. 107108094, filed on Mar. 9, 2018. The entire content of the above identified application is incorporated herein by reference.

BACKGROUND OF THE PRESENT DISCLOSURE

At present, antennas used in ordinary network/communication products, for example, dipole antennas, usually have omnidirectional radiation patterns. However, when a position of such a product is fixed, signal transmission and reception can only rely on fixed radiation, which results in poor signal performance and reduced transmission speed.

In addition, a conventional antenna design uses multiple fixed-position antennas to control an overall radiation pattern. However, this approach has met considerable design limitations due to space constraints and cost considerations.

Further, a conventional antenna has only one polarization direction, for example, a horizontal polarization direction or a vertical polarization direction. Therefore, antenna signals cannot be transmitted effectively.

SUMMARY OF THE PRESENT DISCLOSURE

In response to the above-referenced technical inadequacies, the present disclosure provides a smart antenna assembly.

In certain aspects, the present disclosure provides an antenna assembly including a first antenna device. The first antenna device includes a first polarization antenna, a second polarization antenna, a first switch unit, a first control terminal and a second control terminal. The first polarization antenna includes a first antenna, a first reflection element disposed on a first side of the first antenna, and a second reflection element disposed on a second side of the first antenna. The second polarization antenna includes a second antenna, a third reflection element disposed on a third side of the second antenna, and a fourth reflection element disposed on a fourth side of the second antenna. The first switch unit includes a first switch element electrically connected to the first reflection element, a second switch element electrically connected to the second reflection element, a third switch element electrically connected to the third reflection element, and a fourth switch element electrically connected to the fourth reflection element. The first control terminal is used for turning on the first switch element and the third switch element. The second control terminal is used for turning on the second switch element and the fourth switch element.

One of the beneficial effects of the present disclosure is that, through the technical features of "the first control terminal is used to turn on the first switch element and the third switch element, and the second control terminal is used to turn on the second switch element and the fourth switch element," the smart antenna assembly can change its radiation pattern.

These and other aspects of the present disclosure will become apparent from the following description of the embodiment taken in conjunction with the following drawings and their captions, although variations and modifications therein can be affected without departing from the spirit and scope of the novel concepts of the present disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
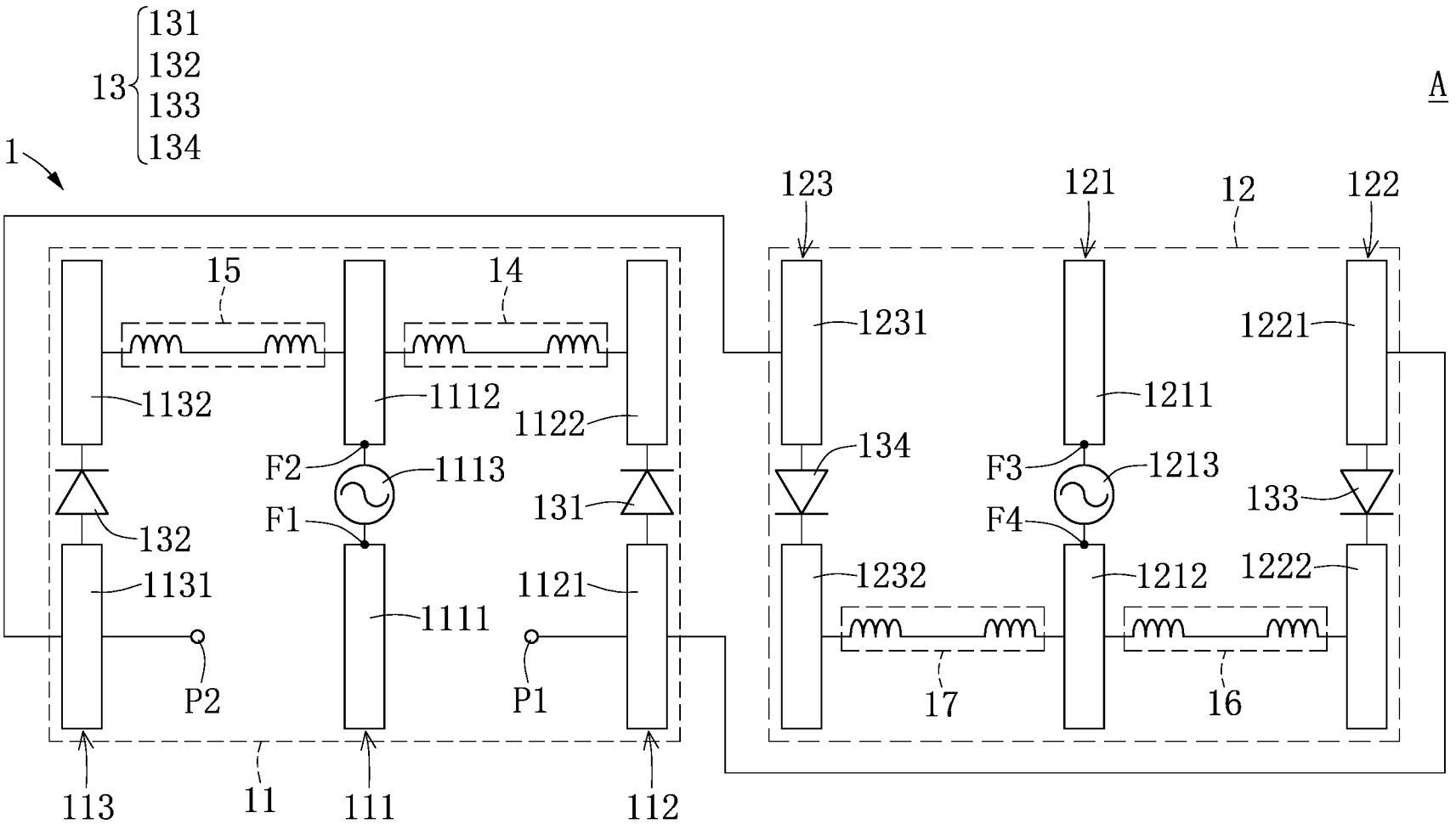
FIG. 1 is a schematic diagram of a first smart antenna device of a smart antenna assembly according to an embodiment of the present disclosure.

The present disclosure is more particularly described in the following examples that are intended as illustrative only since numerous modifications and variations therein will be apparent to those skilled in the art. Various embodiments of the present disclosure are now described in detail. Referring to the drawings, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles can be used in the specification for the convenience of a reader, which shall have no influence on the scope of the present disclosure. Additionally, some terms used in this specification are more specifically defined below.

The terms used in this specification generally have their ordinary meanings in the art, within the context of the present disclosure, and in the specific context where each term is used. Certain terms that are used to describe the present disclosure are discussed below, or elsewhere in the specification, to provide additional guidance to the practitioner regarding the description of the present disclosure. For convenience, certain terms can be highlighted, for example using italics and/or quotation marks. The use of highlighting has no influence on the scope and meaning of a term; the scope and meaning of a term is the same, in the same context, whether or not it is highlighted. It will be appreciated that the same thing can be expressed in more than one way. Consequently, alternative language and synonyms can be used for any one or more of the terms discussed herein, and no special significance is to be placed upon whether or not a term is elaborated or discussed herein. Synonyms for certain terms can be provided. A recital of one or more synonyms does not exclude the use of other synonyms. The use of examples anywhere in this specification including examples of any terms discussed herein is illustrative only, and in no way limits the scope and meaning of the present disclosure or of any exemplified term. Likewise, the present disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including any definitions given herein, will prevail.

While numbering terms such as "first", "second" or "third" can be used in this disclosure to describe various components, signals or the like, the terms are for distinguishing one component from another component, or one signal from another signal only, and are not intended to, nor should they be construed to impose any other substantive descriptive limitations on the components, signals or the like.

Figure 13:
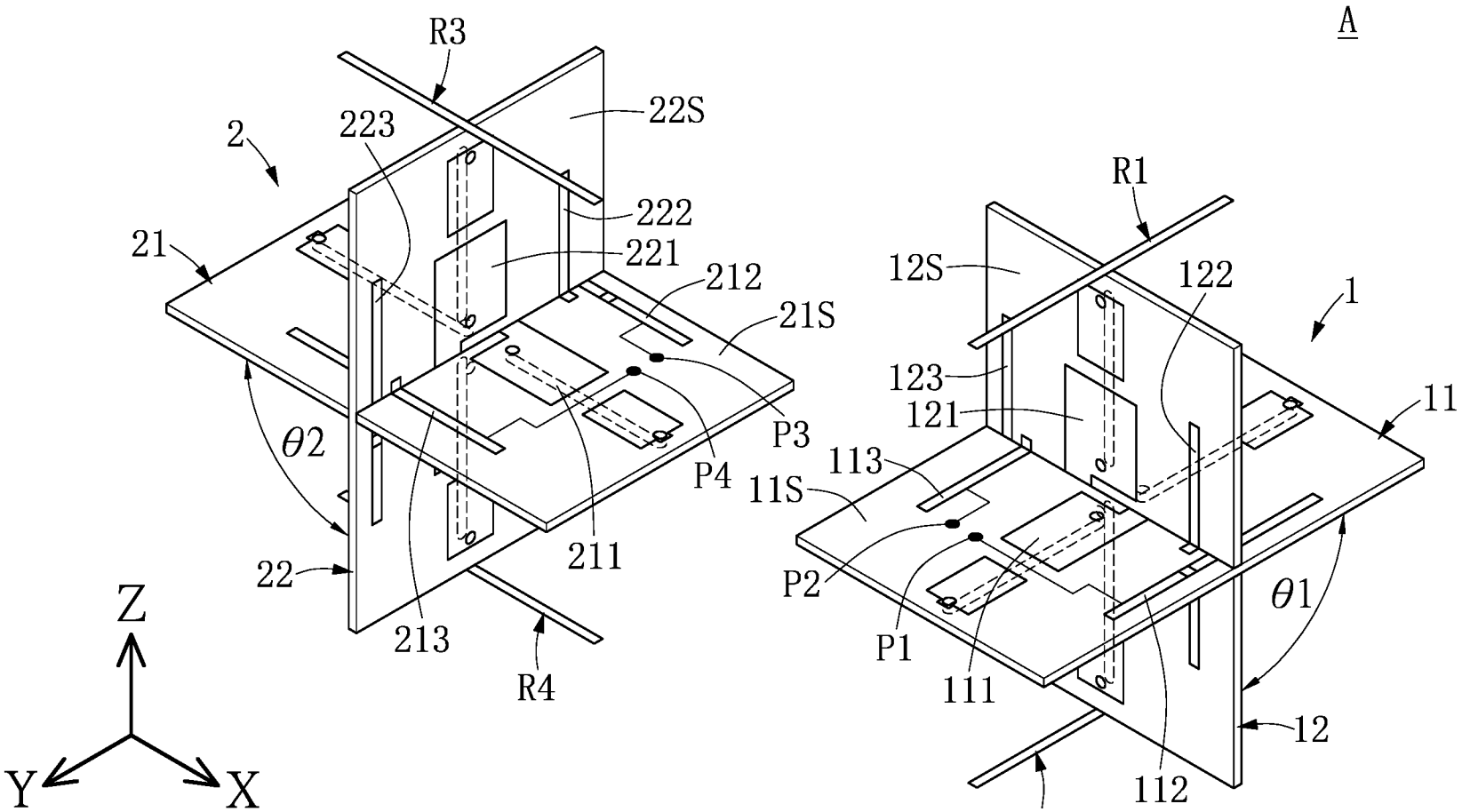
FIG. 13 is a schematic perspective view of the first smart antenna device and the second smart antenna device arranged adjacent to each other according to an embodiment of the present disclosure.

First, reference is made to FIG. 1, which is a schematic diagram of a first smart antenna device of a smart antenna assembly according to an embodiment of the present disclosure. It should be noted that the smart antenna assembly A of the present disclosure can preferably include a first smart antenna device 1 and a second smart antenna device 2 (as shown in FIG. 13). Nevertheless, a smart antenna assembly A including only the first smart antenna device 1, that is, without the second smart antenna device 2, can still be implemented. The embodiment(s) in which the smart antenna assembly A includes a first smart antenna device 1 are described as follows.

Referring again to FIG. 1, the present disclosure provides a smart antenna assembly A, which includes a first smart antenna device 1. The first smart antenna device 1 can include a first polarization antenna 11, a second polarization antenna 12, a first switch unit 13, a first control terminal P1 and a second control terminal P2. For example, the polarization direction of the first polarization antenna 11 and the polarization direction of the second polarization antenna 12 are different from each other. In certain embodiments, the polarization directions of the first polarization antenna 11 and the second polarization antenna 12 are substantially orthogonal to each other. In addition, in one embodiment, the first polarization antenna 11 can be a horizontal polarization antenna, and the second polarization antenna 12 can be a vertical polarization antenna. However, the present disclosure is not limited thereto. In certain embodiments, referring again to FIG. 1, the first polarization antenna 11 can include a first antenna 111, a first reflection element 112 disposed on a first side (for example, the right side) of the first antenna 111, and a second reflection element 113 disposed on a second side (for example, the left side) of the first antenna 111. The second polarization antenna 12 can include a second antenna 121, a third reflection element 122 disposed on a third side (for example, the right side) of the second antenna 121, and a fourth reflection element 123 disposed on a fourth side (for example, the left side) of the second antenna 121. For example, the first antenna 111 and the second antenna 121 can be collectively implemented by a dipole antenna. The first antenna 111 and the second antenna 121 can generate at least one operating frequency band, and the frequency range of the operating frequency band can be between 5150 MHz and 5850 MHz, so that the first smart antenna device 1 is operable within the 5G Wireless Local Area Network (WLAN) band. However, the present disclosure is not limited thereto. In other embodiments, the smart antenna assembly A can be a dual-frequency (2.4G/5G) dual-polarization antenna. That is, each of the first antenna 111 and the second antenna 121 has two operating frequency bands, for example, an operating frequency band between 5150 MHz and 5850 MHz, and an operating frequency band between 2400 MHz and 2500 MHz. However, the present disclosure is not limited thereto. In addition, it should be noted that in the following embodiments, the first antenna 111 and the second antenna 121 with operating frequency band ranges between 5150 MHz and 5850 MHz are provided as examples and for illustration purpose only.

In certain embodiments, referring again to FIG. 1, the first reflection element 112 and the second reflection element 113 can be respectively disposed in parallel on two opposite sides (for example, the right and left sides) of the first antenna 111. The third reflection element 122 and the fourth reflection element 123 can be respectively disposed in parallel on opposite sides (for example, the right side and left side) of the second antenna 121. In this way, the radiation pattern of the first antenna 111 can be changed by conducting one of the first reflection element 112 and the second reflection element 113. And the radiation pattern of the second antenna 121 can be changed by conducting one of the third reflection element 122 and the fourth reflection element 123. The details of the radiation pattern changes are specified in the following embodiments.

In certain embodiments, referring again to FIG. 1, preferably, the distance between the first reflection element 112 and the first antenna 111 is between one-eighth and one-fourth of the wavelength of the operating frequency of the first antenna 111, that is, between 0.125λ and 0.25λ. The distance between the second reflection element 113 and the first antenna 111 is between one-eighth and one-fourth of the wavelength of the operating frequency of the first antenna 111, that is, between 0.125λ and 0.25λ. The distance between the third reflection element 122 and the second antenna 121 is between one-eighth and one-fourth of the wavelength of the operating frequency of the second antenna 121, that is, between 0.125λ and 0.25λ. The distance between the fourth reflection element 123 and the second antenna 121 is between one-eighth and one-fourth of the wavelength of the operating frequency of the second antenna 121, that is, between 0.125λ and 0.25λ. In certain embodiments, the above-referenced operating frequency can be the center frequency of the operating frequency band of the smart antenna assembly A. However, the present disclosure is not limited thereto. In certain embodiments, when the antenna(s) of the smart antenna assembly A is a dual-frequency dual-polarization antenna, the center frequency of a higher operating frequency band supported by the smart antenna assembly A can be selected as the operating frequency of the smart antenna assembly A. Therefore, the distances between the first antenna 111 and the reflection elements are shorter, so that the overall volume of the smart antenna assembly A is reduced. In other words, when the first polarization antenna 11 supports a first operating frequency band and a second operating frequency band, the second polarization antenna 12 supports a third operating frequency band and a fourth operating frequency band, the center frequency of the first operating frequency band is higher than the center frequency of the second operating frequency band, and the center frequency of the third operating frequency band is higher than the center frequency of the fourth operating frequency band, the distance between the first reflection element 112 and the first antenna 111 can be between one-eighth and one-fourth of the wavelength of the center frequency of the first operating frequency band of the first antenna 111, the distance between the second reflection element 113 and the first antenna 111 can be between one-eighth and one-fourth of the wavelength of the center frequency of the first operating frequency band of the first antenna 111, the distance between the third reflection element 122 and the second antenna 121 can be between one-eighth and one-fourth of the wavelength of the center frequency of the third operating frequency band of the second antenna 121, and the distance between the fourth reflection element 123 and the second antenna 121 can be between one-eighth and one-fourth of the wavelength of the center frequency of the third operating frequency band of the second antenna 121. In certain embodiments, more preferably, the distance between the first reflection element 112 and the first antenna 111 is the same as the distance between the second reflection element 123 and the first antenna 111. And the distance between the third reflection element 122 and the second antenna 121 is the same as the distance between the fourth reflection element 123 and the second antenna 121. In certain embodiments, the first operating frequency band is the same as the third operating frequency band, and the second operating frequency band is the same as the fourth operating frequency band. However, the present disclosure is not limited thereto.

In certain embodiments, referring again to FIG. 1, the first switch unit 13 can include a first switch element 131 electrically connected to the first reflection element 112, a second switch element 132 electrically connected to the second reflection element 113, a third switch element 133 electrically connected to the third reflection element 122, and a fourth switch element 134 electrically connected to the fourth reflection element 123. For example, at least one of the first switch element 131, the second switch element 132, the third switch element 133 and the fourth switch element 134 can be a diode or a metal-oxygen-semiconductor field-effect transistor (MOSFET). However, the present disclosure is not limited thereto. In certain embodiments, other types of unidirectional switch elements can also be used. In addition, it should be noted that, the first switch element 131, the second switch element 132, the third switch element 133 and the fourth switch element 134 can be respectively connected in series to the conducting path of the first reflection element 112, the conducting path of the second reflection element 113, the conducting path of the third reflection element 122, and the conducting path of the fourth reflection element 123. Thereby, the first switch element 131, the second switch element 132, the third switch element 133 and the fourth switch element 134 can be used to respectively control the conducting of the first reflection element 112, the second reflection element 113, the third reflection element 122 and the four reflection elements 123.

In certain embodiments, referring again to FIG. 1, one of the first control terminal P1 and the second control terminal P2 can output a first direct current (DC) signal. In certain embodiments, for example, the first control terminal P1 can be electrically connected to the first reflection element 112 and the third reflection element 122, and the second control terminal P2 can be electrically connected to the second reflection element 113 and the fourth reflection element. 123. Thereby, the first direct current signal can be inputted into the first reflection element 112 and the third reflection element 122 at the same time, or be inputted into the second reflection element 113 and the fourth reflection element 123 at the same time. It should be noted that, when the first control terminal P1 and the second control terminal P2 are directly electrically connected to diodes, each reflection element will become a director. Therefore, preferably, the first control terminal P1 and the second control terminal P2 are indirectly electrically connected to the diodes through the reflection elements.

In certain embodiments, when the first control terminal P1 outputs the first direct current signal, the first control terminal P1 can be used to turn on the first switch element 131 and the third switch element 133. When the second control terminal P2 outputs the first direct current signal, the second control terminal P2 can be used to turn on the second switch element 132 and the fourth switch element 134. In this way, the first reflection element 112 and the third reflection element 122, or the second reflection element 113 and the fourth reflection element 123 can be selectively configured to be conductive at the same time, so as to control the radiation pattern of the first antenna 111 and the second antenna 121.

Figure 2:
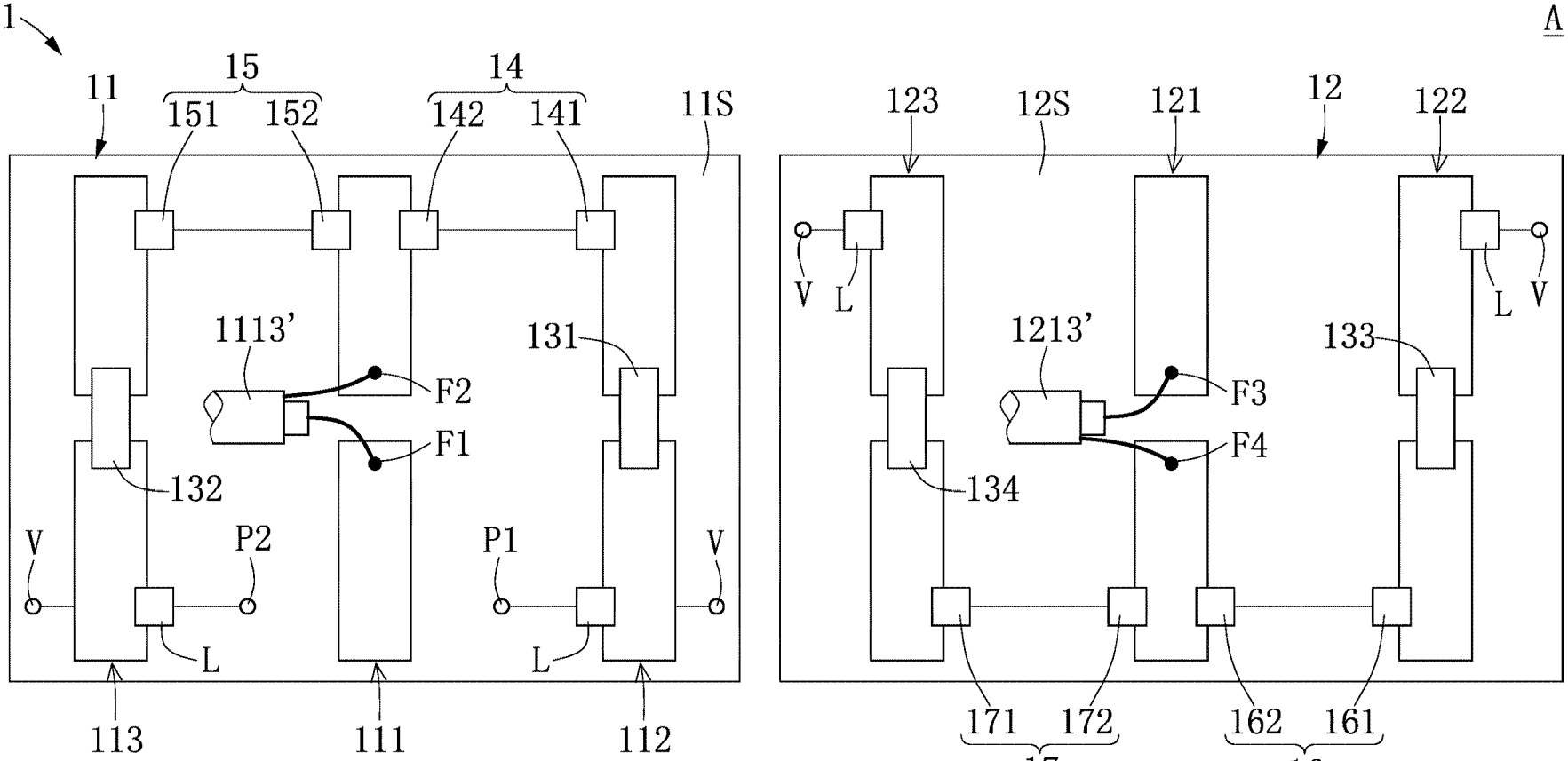
FIG. 2 is a schematic diagram of the first smart antenna device of the smart antenna assembly implemented on a substrate according to an embodiment of the present disclosure.
Figure 3:
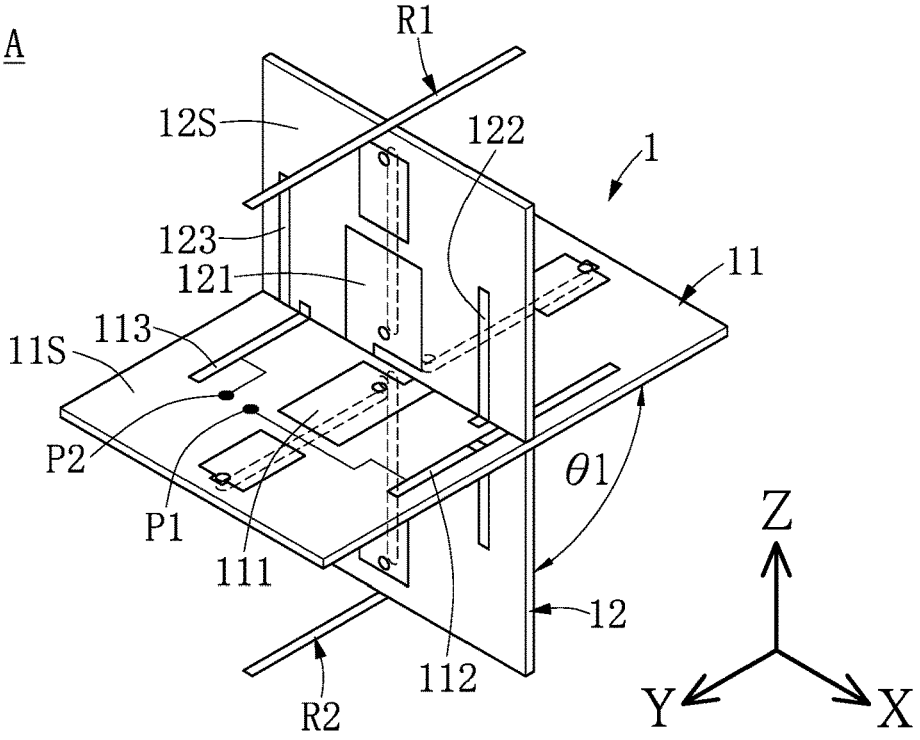
FIG. 3 is a perspective assembled view of the first smart antenna device of the smart antenna assembly according to an embodiment of the present disclosure.
Figure 4:
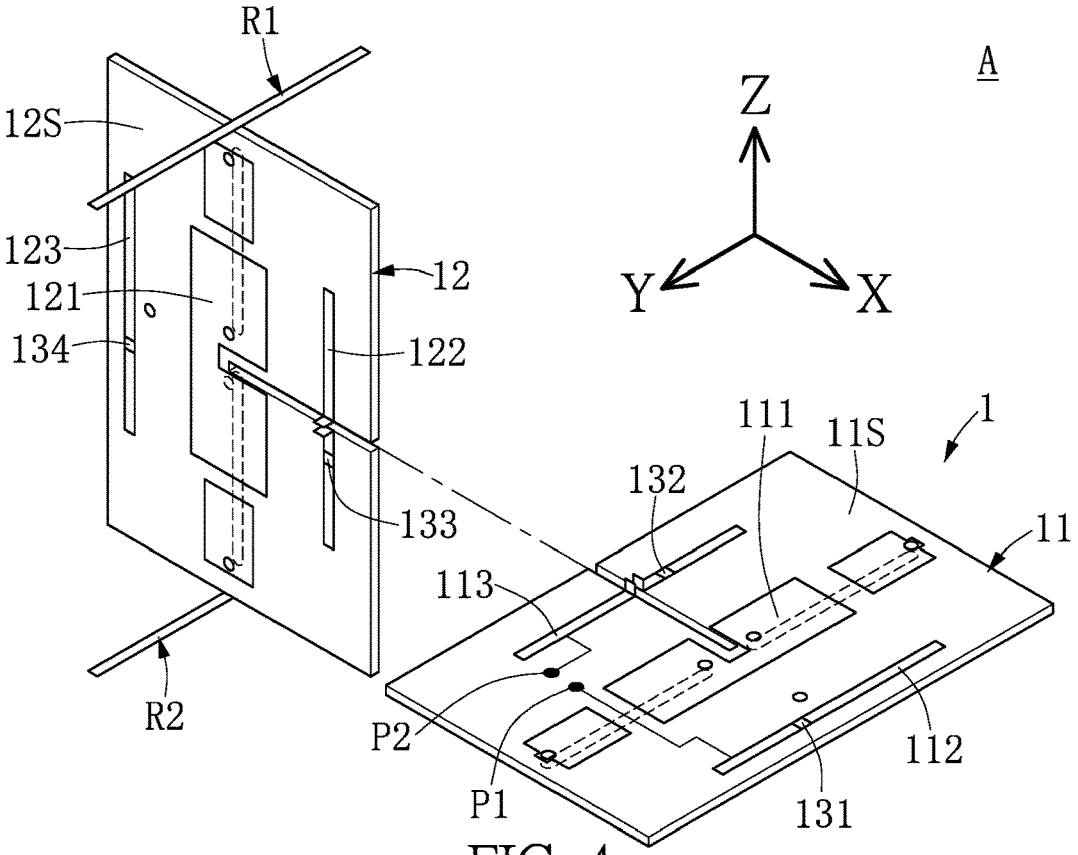
FIG. 4 is a perspective exploded view of the first smart antenna device of the smart antenna assembly according to an embodiment of the present disclosure.

Reference is made again to FIG. 1, and also to FIG. 2 to FIG. 4. FIG. 2 is a schematic diagram of the first smart antenna device 1 of the smart antenna assembly A implemented on a substrate according to an embodiment of the present disclosure. FIG. 3 is a perspective assembled view of the first smart antenna device 1 of the smart antenna assembly A according to an embodiment of the present disclosure. FIG. 4 is a perspective exploded view of the first smart antenna device 1 of the smart antenna assembly A according to an embodiment of the present disclosure. Specifically, the smart antenna assembly A can further include a first substrate 11S and a second substrate 12S. The first polarization antenna 11 can be disposed on the first substrate 11S, and the second polarization antenna 12 can be disposed on the second substrate 12S. The first substrate 11S and the second substrate 12S are arranged substantially perpendicular to each other. In certain embodiments, a first predetermined included angle θ1 between the first substrate 11S and the second substrate 12S is between 80 degrees and 100 degrees. It should be noted that, when the first substrate 11S and the second substrate 12S are arranged substantially perpendicular to each other, an antenna isolation can be maximized, so as to reduce radiation signal interference. In certain embodiments, each of the first substrate 11S and the second substrate 12S can be a microwave substrate. The microwave substrate can be, for example, a printed circuit board (PCB). The first polarization antenna 11 and the polarization antennas 12 can be fabricated respectively on the first substrate 11S and the second substrate 12S by using etching techniques. However, the present disclosure is not limited thereto.

Referring again to FIG. 1 and FIG. 2, in certain embodiments, the first reflection element 112 can include a first section 1121 and a second section 1122. The first switch element 131 can be electrically connected between the first section 1121 and the second section 1122. The second reflection element 113 can include a third section 1131 and a fourth section 1132. The second switch element 132 can be electrically connected between the third section 1131 and the fourth section 1132. The third reflection element 122 can include a fifth section 1221 and a sixth section 1222. The third switch element 133 can be electrically connected between the fifth section 1221 and the sixth section 1222. The fourth reflection element 123 can include a seventh section 1231 and an eighth section 1232. The fourth switch element 134 can be electrically connected between the seventh section 1231 and the eighth section 1232. It is also noted that any following embodiments of the present disclosure with each of the first, second, third and fourth switch elements 131 to 134 being a diode are provided for illustration purpose only.

Referring again to FIG. 1 and FIG. 2, the first control terminal P1 can be electrically connected to the first section 1121 of the first reflection element 112. The first section 1121 of the first reflection element 112 can be electrically connected to the anode of the diode 131. The cathode of the diode 131 can be electrically connected to the second section 1122 of the first reflection element 112. The first section 1121 of the first reflection element 112 can be electrically connected to the fifth section 1221 of the third reflection element 122. The fifth section 1221 of the third reflection element 122 can be electrically connected to the anode of the diode 133. The cathode of the diode 133 can be electrically connected to the sixth section 1222 of the third reflection element 122. In addition, it is worth noting that the second section 1122 of the first reflection element 112 and the sixth section 1222 of the third reflection element 122 can be electrically connected to ground. Further, the second control terminal P2 can be electrically connected to the third section 1131 of the second reflection element 113, and the third section 1131 of the second reflection element 113 can be electrically connected to the anode of the diode 132. The cathode of the diode 132 can be electrically connected to the fourth section 1132 of the second reflection element 113. The third section 1131 of the second reflection element 113 can be electrically connected to the seventh section 1231 of the fourth reflection element 123. The seventh section 1231 of the fourth reflection element 123 can be electrically connected to the anode of the diode 134. The cathode of the diode 134 can be electrically connected to the eighth section 1232 of the fourth reflection element 123. In addition, it is worth noting that the fourth section 1132 of the second reflection element 113 and the eighth section 1232 of the fourth reflection element 123 can be electrically connected to ground. Further, it is also worth noting that when the first polarization antenna 11 and the second polarization antenna 12 are respectively disposed on the first substrate 11S and the second substrate 12S, via holes V or other kinds of conducting sheets can be used so that the first section 1121 of the first reflection element 112 is electrically connected to the fifth section 1221 of the third reflection element 122, and that the third section 1131 of the second reflection element 113 can be electrically connected to the seventh section 1231 of the fourth reflection element 123. However, the present disclosure is not limited thereto.

Referring again to FIG. 1 and FIG. 2, the first antenna 111 can further include a first radiating portion 1111, a second radiating portion 1112, and a first feeding element 1113 for receiving a first radio frequency (RF) signal. The first feeding element 1113 can have a first signal feeding terminal F1 and a first ground terminal F2. The first signal feeding terminal F1 can be electrically connected to the first radiating portion 1111. The first ground terminal F2 can be electrically connected to the second radiating portion 1112. The second radiating portion 1112 can be electrically connected to the second section 1122 of the first reflection element 112 and the fourth section 1132 of the second reflection element 113. In certain embodiments, as shown in FIG. 1 and FIG. 2, the first feeding element 1113 can be a first coaxial cable 1113'. The first coaxial cable 1113' can have the first signal feeding terminal F1 and the first ground terminal F2. Therefore, the first coaxial cable 1113' can be used to feed the first radio frequency signal to the first antenna 111. In addition, it should be noted that, in order to make the figures of the present disclosure easily understandable, the first feeding element 1113 in FIG. 1 is represented by an alternative symbol to indicate the structure of the coaxial cable shown in FIG. 2, as well as the electrical connection configuration of the signal transmission therein. However, the present disclosure is not limited thereto.

Referring again to FIG. 1 and FIG. 2, the second antenna 121 can further include a third radiating portion 1211, a fourth radiating portion 1212, and a second feeding element 1213 for receiving a second radio frequency signal. The second feeding element 1213 can have a second signal feeding terminal F3 and a second ground terminal F4. The second signal feeding terminal F3 can be electrically connected to the third radiating portion 1211, and the second ground terminal F4 can be electrically connected to the fourth radiating portion 1212. The fourth radiating portion 1212 is electrically connected to the sixth section 1222 of the third reflection element 122 and the eighth section 1232 of the fourth reflection element 123. In certain embodiments, as shown in FIG. 1 and FIG. 2, the second feeding element 1213 can be a second coaxial cable line 1213'. The second coaxial cable 1213' can have the second signal feeding terminal F3 and the second ground terminal F4. Therefore, the second coaxial cable 1213' can be used to feed the second radio frequency signal to the second antenna 121.

Referring again to FIG. 1 and FIG. 2, in certain embodiments, the second section 1122 of the first reflection element 112 and the fourth section 1132 of the second reflection element 113 can share a common ground with the second radiating portion 1112 of the first antenna 111. The sixth section 1222 of the third reflection element 122 and the eighth section 1232 of the fourth reflection element 123 can share a common ground with the fourth radiating portion 1212 of the second antenna 121. Therefore, the second section 1122 of the first reflection element 112 and the fourth section 1132 of the second reflection element 113 can be electrically connected to the second radiating portion 1112 of the first antenna 111. Further, the sixth section 1222 of the third reflection element 122 and the eighth section 1232 of the fourth reflection element 123 can be electrically connected to the fourth radiating section 1212 of the second antenna 121. However, the present disclosure is not limited thereto.

Further, referring again to FIG. 1 and FIG. 2, in certain embodiments, the first smart antenna device 1 can further include a first radio frequency choke unit 14 electrically connected between the second section 1122 of the first reflection element 112 and the second radiating portion 1112 of the first antenna 111, a second radio frequency choke unit 15 electrically connected between the fourth section 1132 of the second reflection element 113 and the second radiating portion 1112 of the first antenna 111, a third radio frequency choke unit 16 electrically connected between the sixth section 1222 of the third reflection element 122 and the fourth radiating portion 1212 of the second antenna 121, and a fourth radio frequency choke unit 17 electronically connected between the eighth section 1232 of the fourth reflection element 123 and the fourth radiating section 1212 of the second antenna 121, so as to filter noise and protect the diodes 131 to 134.

Further, referring again to FIG. 1 to FIG. 4, the first radio frequency choke unit 14, the second radio frequency choke unit 15, the third radio frequency choke unit 16 and the fourth radio frequency choke unit 17 can be surface-mount devices (SMD), and can be respectively connected to the first substrate 11S and the second substrate 12S through surface-mounting processes. However, the present disclosure is not limited thereto. In certain embodiments, the first radio frequency choke unit 14 can include a first radio frequency choke element 141 and a second radio frequency choke element 142 connected in series with each other. The first radio frequency choke element 141 and the second radio frequency choke element 142 can be connected by a wire (not labeled in the figures) disposed between the first radio frequency choke element 141 and the second radio frequency choke element 142. The first radio frequency choke element 141 can be electrically connected to the second section 1122 of the first reflection element 112. The second radio frequency choke element 142 can be electrically connected to the second radiating portion 1112 of the first antenna 111. Preferably, the first radio frequency choke element 141 can abut against an edge of the second section 1122 of the first reflection element 112, and the second radio frequency choke element 142 can abut against an edge of the second radiating portion 1112 of the first antenna 111. Further, the second radio frequency choke unit 15 can include a third radio frequency choke element 151 and a fourth radio frequency choke element 152 connected in series with each other. The third radio frequency choke element 151 and the fourth radio frequency choke element 152 can be connected by a wire (not labeled in the figure) disposed between the third radio frequency choke element 151 and the fourth radio frequency choke element 152. The third radio frequency choke element 151 can be electrically connected to the fourth section 1132 of the second reflection element 113. The fourth radio frequency choke element 152 can be electrically connected to the second radiating portion 1112 of the first antenna 111. Preferably, the third radio frequency choke element 151 can abut against an edge of the fourth section 1132 of the second reflection element 113, and the fourth radio frequency choke element 152 can abut against an edge of the second radiating portion 1112 of the first antenna 111. Further, the third radio frequency choke unit 16 can include a fifth radio frequency choke element 161 and a sixth radio frequency choke element 162 connected in series with each other. The fifth radio frequency choke element 161 and the sixth radio frequency choke element 162 can be connected by a wire (not labeled in the figure) disposed between the fifth radio frequency choke element 161 and the sixth radio frequency choke element 162. The radio frequency choke element 161 can be electrically connected to the sixth section 1222 of the third reflection element 122, and the sixth radio frequency choke element 162 can be electrically connected to the fourth radiating portion 1212 of the second antenna 121. Preferably, the fifth radio frequency choke element 161 can abut against an edge of the sixth section 1222 of the third reflection element 122, and the sixth radio frequency choke element 162 can abut against an edge of the fourth radiation part 1212 of the second antenna 121. Further, the fourth radio frequency choke unit 17 can include a seventh radio frequency choke element 171 and an eighth radio frequency choke element 172 connected in series with each other. The seventh radio frequency choke element 171 and the eighth radio frequency choke element 172 can be connected by a wire (not labeled in the figure) disposed between the seventh radio frequency choke element 171 and the eighth radio frequency choke element 172. The seventh radio frequency choke element 171 can be electrically connected to the eighth section 1232 of the fourth reflection element 123. The eighth radio frequency choke element 172 can be electrically connected to the fourth radiation part 1212 of the second antenna 121. Preferably, the seventh radio frequency choke element 171 can abut against an edge of the eighth section 1232 of the fourth reflection element 123, and the eighth radio frequency choke element 172 can abut against an edge of the fourth radiation part 1212 of the second antenna 121. Thereby, the technical features of radio frequency choke elements abutting against adjacent reflection elements (the first reflection element 112, the second reflection element 113, the third reflection element 122 and the fourth reflection element 123) and abutting against adjacent antenna elements (the first antenna 111 and the second antenna 121) can prevent the antenna elements (the first antenna 111 and the second antenna 121) from generating stubs affecting antenna resonant frequencies and impedance matchings. Further, the technical feature can also prevent reflection elements (the first reflection element 112, the second reflection element 113, the third reflection element 122 and the fourth reflection element 123) from generating stubs affecting antenna pattern switching performance, that is, antenna gain.

In certain embodiments, as shown in FIG. 1 and FIG. 2, the radio frequency choke elements 151, 152, 161, 162, 171, 172, 181 and 182 can be inductors. However, the present disclosure is not limited thereto. Further, preferably, for the purpose of further filtering noise, choke elements L can be disposed between the first control terminal P1 and the first section 1121 of the first reflection element 112, and between the second control terminal P2 and the third section 1131 of the second reflection element 113. Further, choke elements L can also be disposed between the first section 1121 of the first reflection element 112 and the fifth section 1221 of the third reflection element 122, and between the third section 1131 of the second reflection element 113 and the seventh section 1231 of the fourth reflection element 123. In certain embodiments, a choke element L can be an inductor. However, the present disclosure is not limited thereto.

Next, referring again to FIG. 1, details of radiation pattern change is further described as follows. One of the first control terminal P1 and the second control terminal P2 can output a first direct current signal. In certain embodiments, when the first direct current signal causes the diodes 131 to 134 to be non-conducting, the first antenna 111 and the second antenna has substantially omnidirectional radiation. When the diode 131 and the diode 133 are conducted and the diode 132 and the diode 134 are not conducted, the radiation patterns of the first antenna 111 and the second antenna 121 can be changed to be one radiating toward a first direction (for example, a left direction). Further, when the diode 132 and the diode 134 of the first smart antenna device 1 are conducted, and the diode 131 and the diode 133 are not conducted, the radiation patterns of the first antenna 111 and the second antenna 121 can be changed to be one radiating toward a second direction (for example, a right direction).

Furthermore, it is worth noting that the smart antenna assembly A can further include a first reflection structure R1 and a second reflection structure R2. The first reflection structure R1 can be disposed on one side (for example, an upper side) of the second antenna 121, and the second reflection structure R2 can be disposed on the other side (for example, the lower side) of the second antenna 121. In this way, the gain of the first smart antenna device 1 of the smart antenna assembly A can be adjusted, and a radiation pattern can be compressed.

Figure 5:
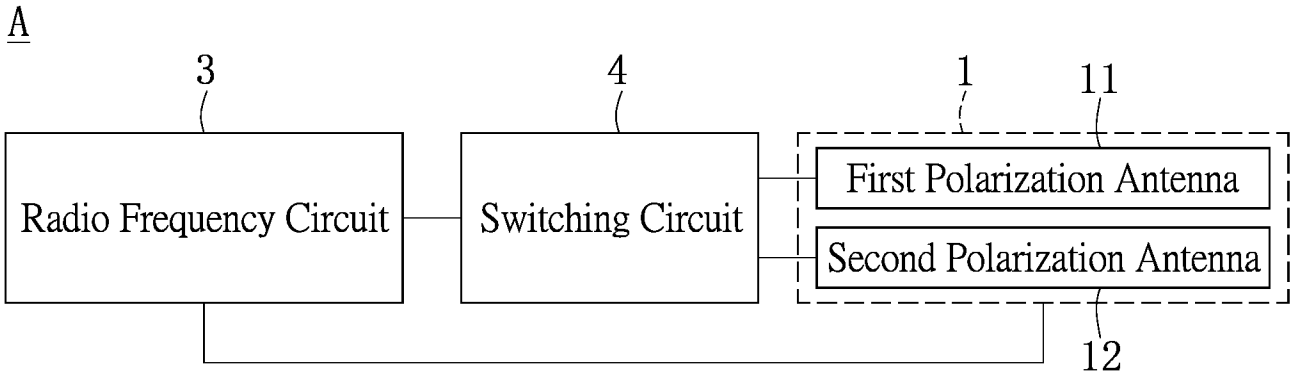
FIG. 5 is a functional block diagram of the smart antenna assembly according to an embodiment of the present disclosure.

Next, reference is made to FIG. 5. FIG. 5 is a functional block diagram of a smart antenna assembly A according to an embodiment of the present disclosure. The smart antenna assembly A can further include a switching circuit 4 and a radio frequency circuit 3. The radio frequency circuit 3 can be electrically connected to the switching circuit 4 to transmit a control signal to the switching circuit 4. Further, the radio frequency circuit 3 can also be electrically connected to the first smart antenna device 1 to transmit the first direct current signal to one of the first control terminal P1 and the second control terminal P2. In certain embodiments, the switching circuit 4 can be electrically connected to the feed receiving elements of the first polarization antenna 11 and the second polarization antenna 12. The switching circuit 4 can select one of the first polarization antenna 11 and the second antennas 12 according to the control signal, so as to transmit a first radio frequency signal of the radio frequency circuit 3 to the first polarization antenna 11, or to transmit a second radio frequency signal of the transmission radio frequency circuit 3 to the second polarization antenna 12. In other words, by adopting the switching circuit 4, a radio frequency signal can be selectively transmitted to one of the first polarization antenna 11 and the second polarization antenna 12. That is, one of the first polarization antenna 11 and the second polarization antenna 12 is selectively turned on. In certain embodiments, the first polarization antenna 11 can be a horizontal polarization antenna, the second polarization antenna 12 can be a vertical polarization antenna, and the switching circuit 4 can switch polarization antennas to transmit a radio frequency to an appropriate polarization antenna for signal transmission according to the control signal. That is, the switching circuit 4 can be used to switch the polarization direction of the first smart antenna device 1.

Figure 6:
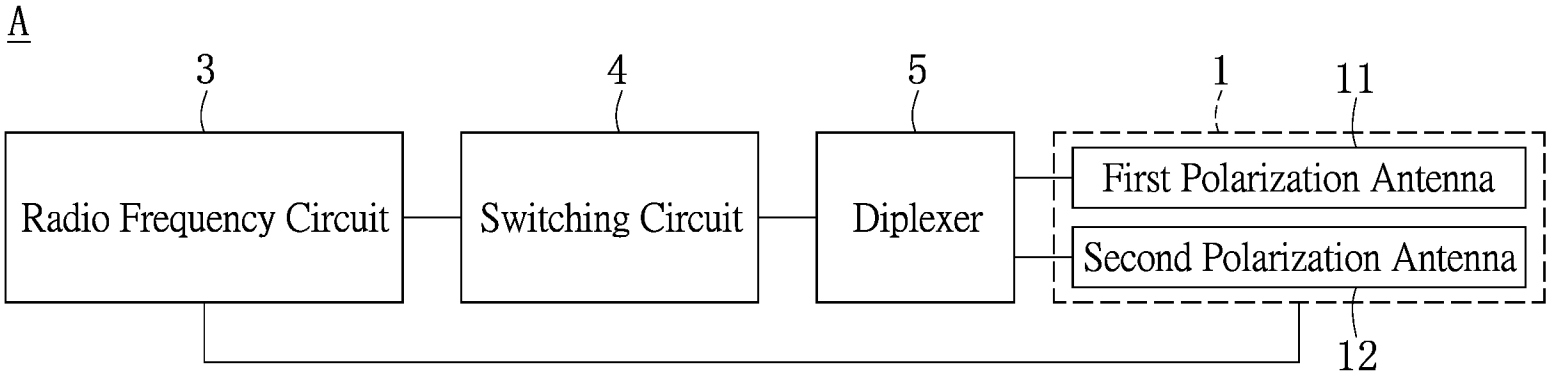
FIG. 6 is another functional block diagram of the smart antenna assembly according to an embodiment of the present disclosure.

Reference is made to FIG. 6, which is another functional block diagram of a smart antenna assembly A according to an embodiment of the present disclosure. In certain embodiments, when the first polarization antenna 11 and the second polarization antenna 12 of the first smart antenna device 1 not only have a first/third operating frequency band between 5150 MHz and 5850 MHz, but further have a second/fourth operating frequency band between 2400 MHz and 2500 MHz, the smart antenna assembly A can further include a diplexer 5. Further, the diplexer 5 can be electrically connected between the switching circuit 4 and the first smart antenna device 1. The diplexer 5 can operate in the first/third operating frequency band and the second/fourth operating frequency band of the first smart antenna device 1. The radio frequency circuit 3 can further include a radio frequency transceiver (not shown in the figure) for the first/third operating frequency band and a radio frequency transceiver (not shown in the figure) for the second/fourth operating frequency band.

Figure 7A:
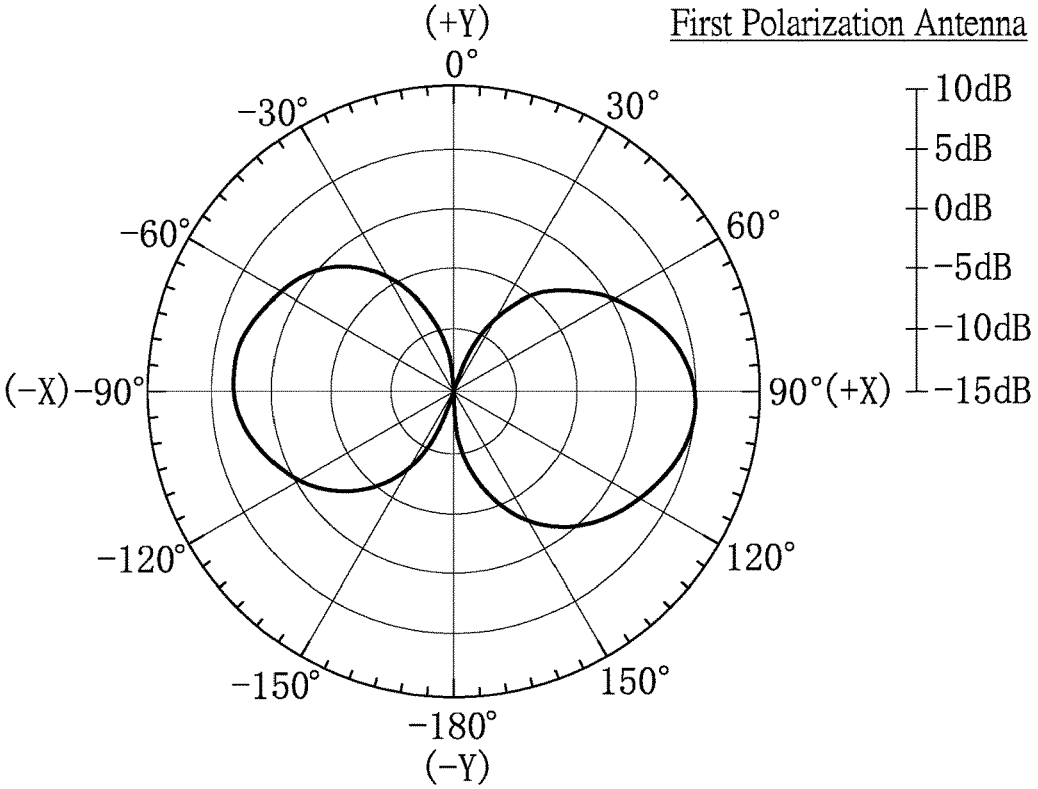
FIG. 7A is a schematic radiation pattern diagram of a first polarization antenna when each of first to fourth switch elements is in a non-conducting state.
Figure 7B:
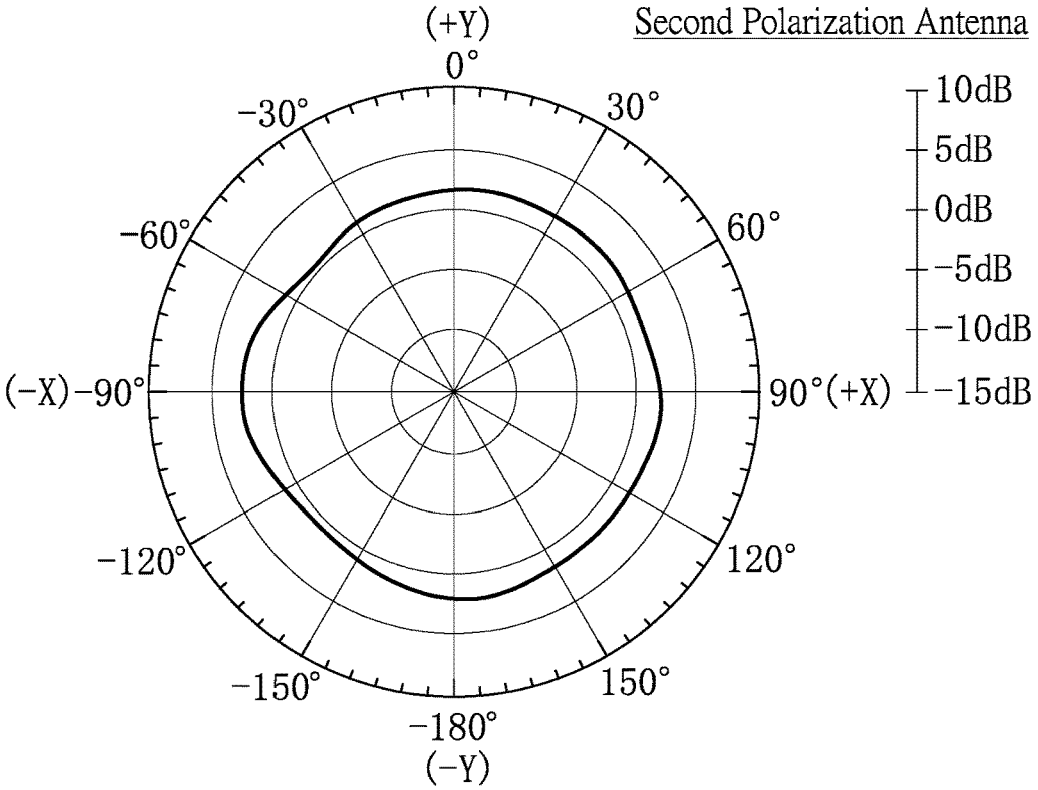
FIG. 7B is a schematic radiation pattern diagram of a second polarization antenna when each of the first to fourth switch elements is in a non-conducting state.
Figure 8A:
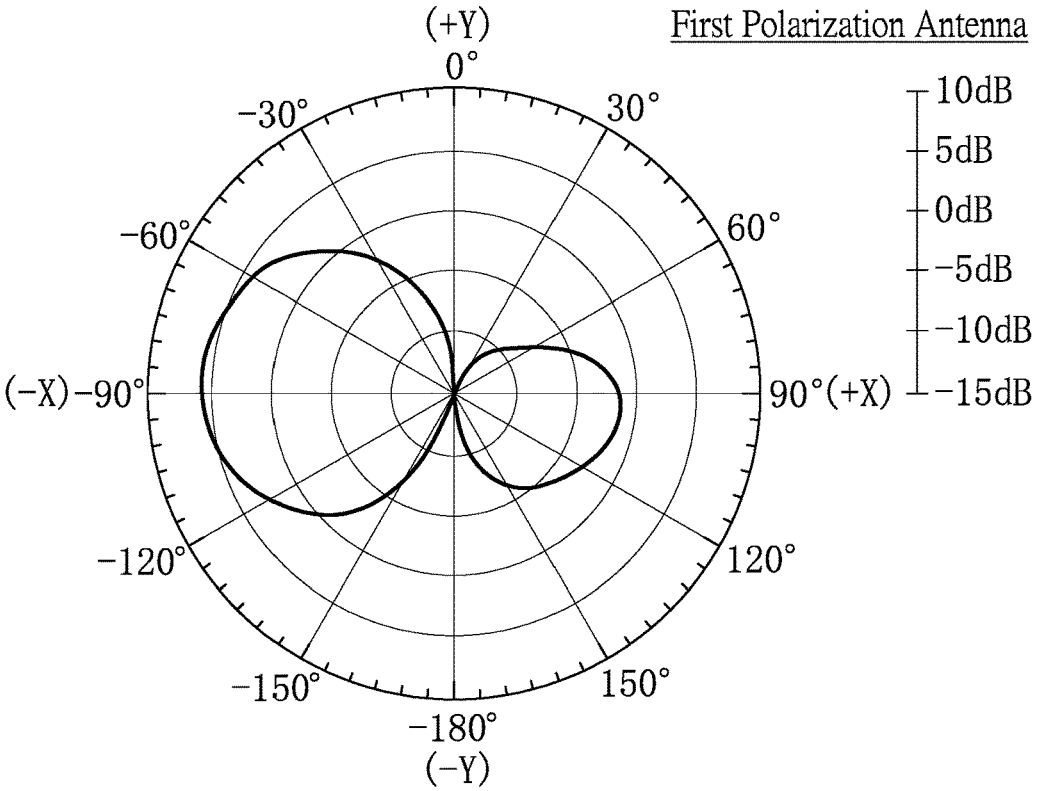
FIG. 8A is a schematic radiation pattern diagram of the first polarization antenna when the first and third switch elements are in a conducting state, and the second and fourth switch elements are in a non-conducting state.
Figure 8B:
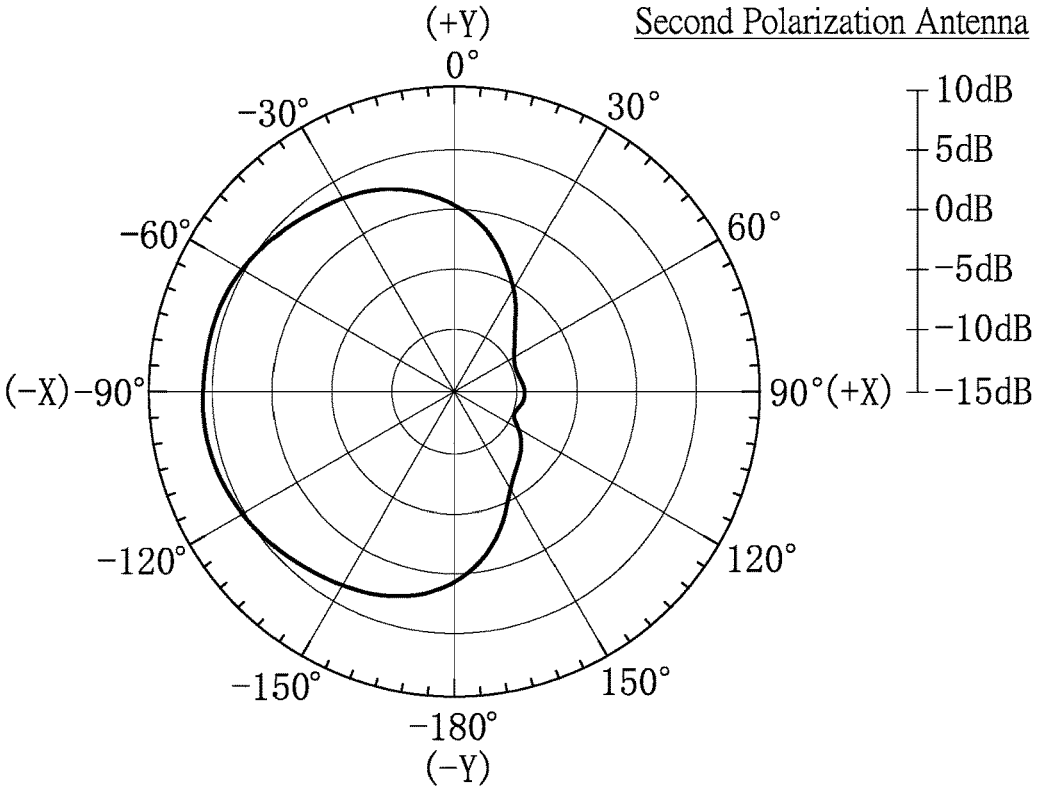
FIG. 8B is a schematic radiation pattern diagram of the second polarization antenna when the first and third switch elements are in a conducting state, and the second and fourth switch elements are in a non-conducting state.
Figure 9A:
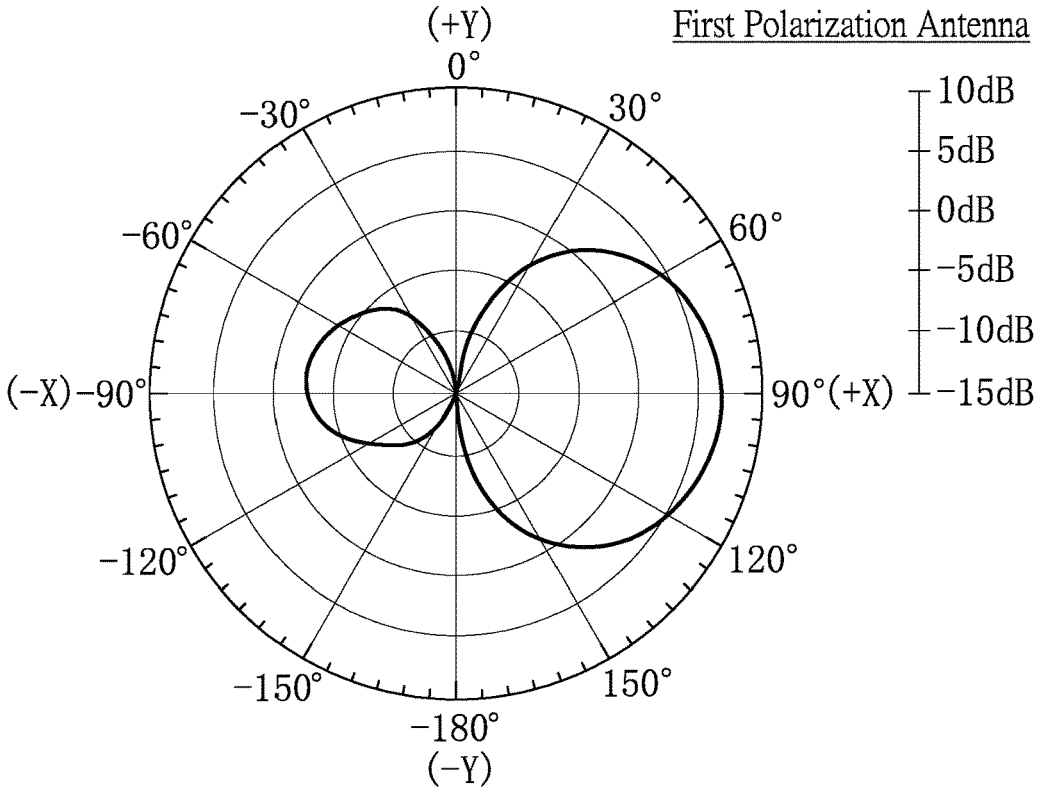
FIG. 9A is a schematic radiation pattern diagram of the first polarization antenna when the second and fourth switch elements are in a conducting state, and the first and third switch elements are in a non-conducting state.
Figure 9B:
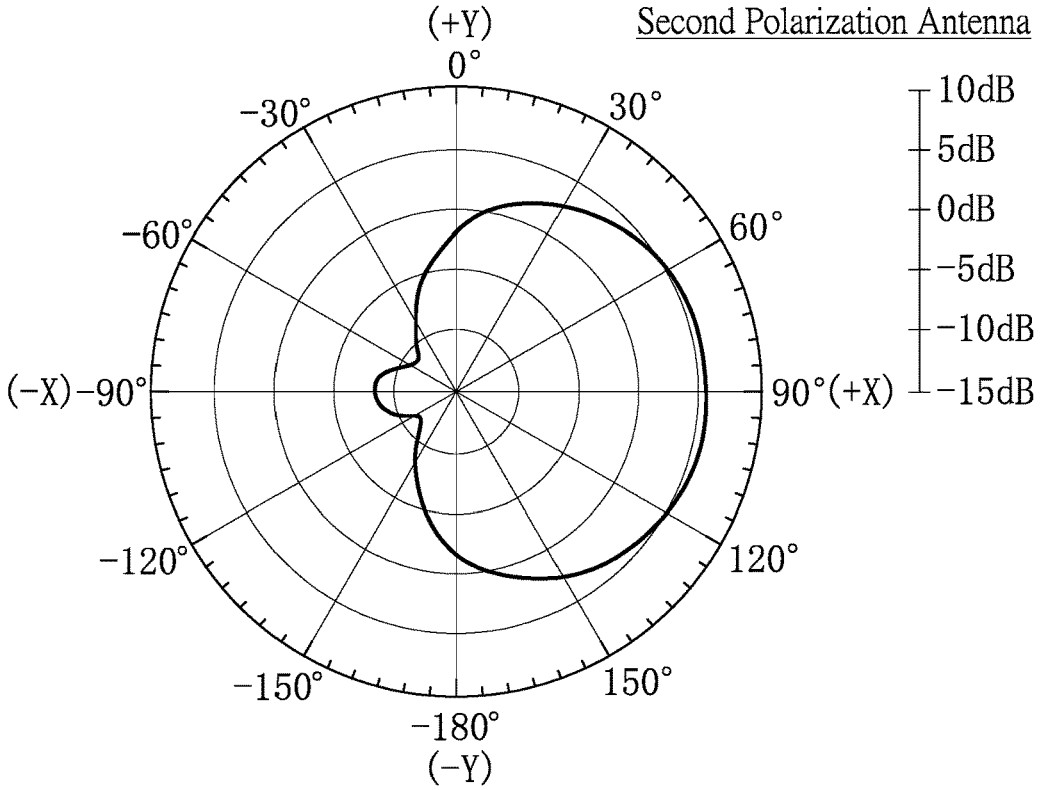
FIG. 9B is a schematic radiation pattern diagram of the second polarization antenna when the second and fourth switch elements are in a conducting state, and the first and third switch elements are in a non-conducting state.

Further, reference is made to FIG. 7A to FIG. 9B. FIG. 7A is a schematic radiation pattern diagram of the first polarization antenna 11 when each of the first to fourth switch elements 131 to 134 is in a non-conducting state. FIG. 7B is a schematic radiation pattern diagram of the second polarization antenna 12 when each of the first to fourth switch elements 131 to 134 is in a non-conducting state. FIG. 8A is a schematic radiation pattern diagram of the first polarization antenna 11 when the first and third switch elements 131 and 133 are in a conducting state, and the second and fourth switch elements 132 and 134 are in a non-conducting state. FIG. 8B is a schematic radiation pattern diagram of the second polarization antenna 12 when the first and third switch elements 131 and 133 are in a conducting state, and the second and fourth switch elements 132 and 134 are in a non-conducting state. FIG. 9A is a schematic radiation pattern diagram of the first polarization antenna 11 when the second and fourth switch elements 132 and 134 are in a conducting state, and the first and third switch elements 131 and 133 are in a non-conducting state. FIG. 9B is a schematic radiation pattern diagram of the second polarization antenna 12 when the second and fourth switch elements 132 and 134 are in a conducting state, and the first and third switch elements 131 and 133 are in a non-conducting state. Embodiments in which the first polarization antenna 11 being a horizontal polarization antenna, and the second polarization antenna 12 being a vertical polarization antenna are provided as follows and for illustrative purpose only.

As shown in FIG. 7A and FIG. 7B, when the radio frequency circuit 3 does not provide the first direct current signal to the first control terminal P1 or the second control terminal P2, the first switch element 131, the second switch element 132, the third switch element 133 and the fourth switch element 134 are not conducted. The switching circuit 4 can select one of the first polarization antenna 11 and the second polarization antenna 12 according to the control signal from the radio frequency circuit 3, so as to transmit a first radio frequency signal to the first polarization antenna 11, or to transmit a second radio frequency signal to the second polarization antenna 12, so that the radiation pattern of one of the first polarization antenna 11 and the second polarization antenna 12 can be an omnidirectional radiation.

As shown in FIG. 8A and FIG. 8B, when the first switch element 131 and the third switch element 133 are turned on by the first control terminal P1 to be conducted, and the switching circuit 4 selects one of the first polarization antenna 11 and the second polarization antenna 12, the radiation pattern of the first smart antenna device 1 can be one directing toward a first direction (for example, the negative direction of the X axis). That is, the switching circuit 4 can selectively use the first polarization antenna 11 or the second polarization antenna 12 according to the control signal from the radio frequency circuit 3, and causes the radiation pattern of the first polarization antenna 11 or the second polarization antenna 12 to be directed toward a first direction.

As shown in FIG. 9A and FIG. 9B, when the second switch element 132 and the fourth switch element 134 are turned on by the second control terminal P2 to be conducted, and the switching circuit 4 selects one of the first polarization antenna 11 and the second polarization antenna 12, the radiation pattern of the first smart antenna device 1 can be one directing toward a second direction (for example, the positive direction of the X axis). That is, the switching circuit 4 can selectively use the first polarization antenna 11 or the second polarization antenna 12 according to the control signal from the radio frequency circuit 3, and causes the radiation pattern of the first polarization antenna 11 or the second polarization antenna 12 to be directed toward a second direction.

Thereby, by comparing FIG. 8A and FIG. 8B with FIG. 9A and FIG. 9B, it can be derived that the radio frequency circuit 3 selects one of the first control terminal P1 and the second control terminal P2 to output a first direct current signal, so that the first smart antenna device 1 can generate radiation patterns with opposite radiation directions, for example, the first direction (the negative direction of the X axis) and the second direction (the positive direction of the X axis) are opposite to each other.

Figure 10:
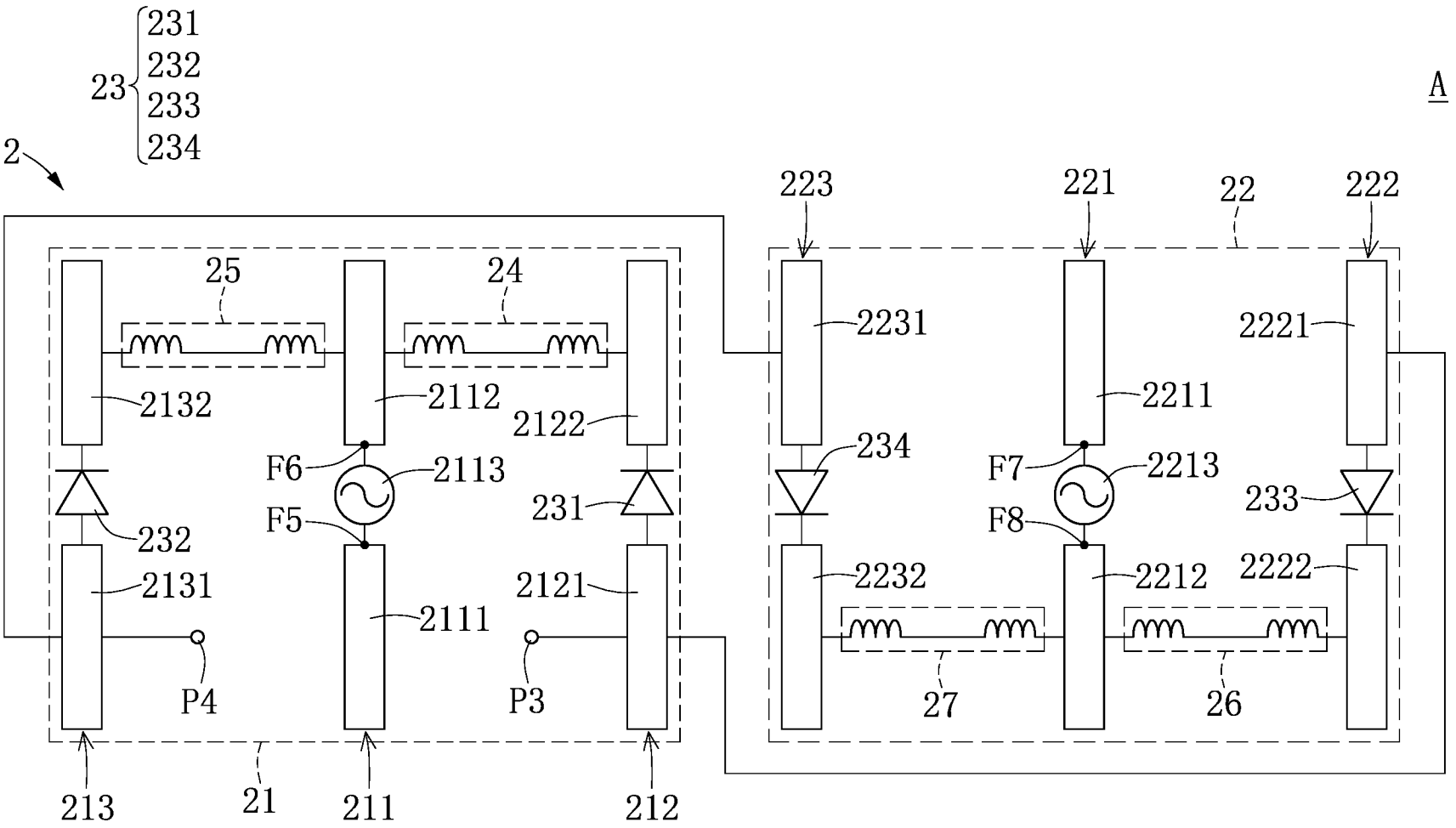
FIG. 10 is a schematic diagram of a second smart antenna device of the smart antenna assembly according to one embodiment of the present disclosure.
Figure 11:
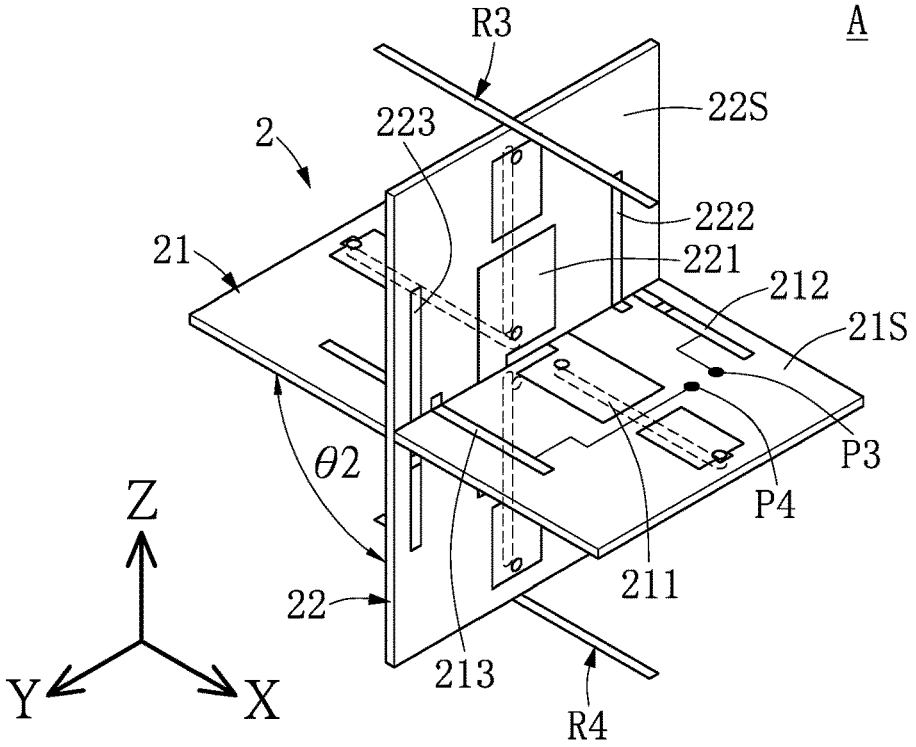
FIG. 11 is a perspective assembled view of the second smart antenna device of the smart antenna assembly according to one embodiment of the present disclosure.
Figure 12:
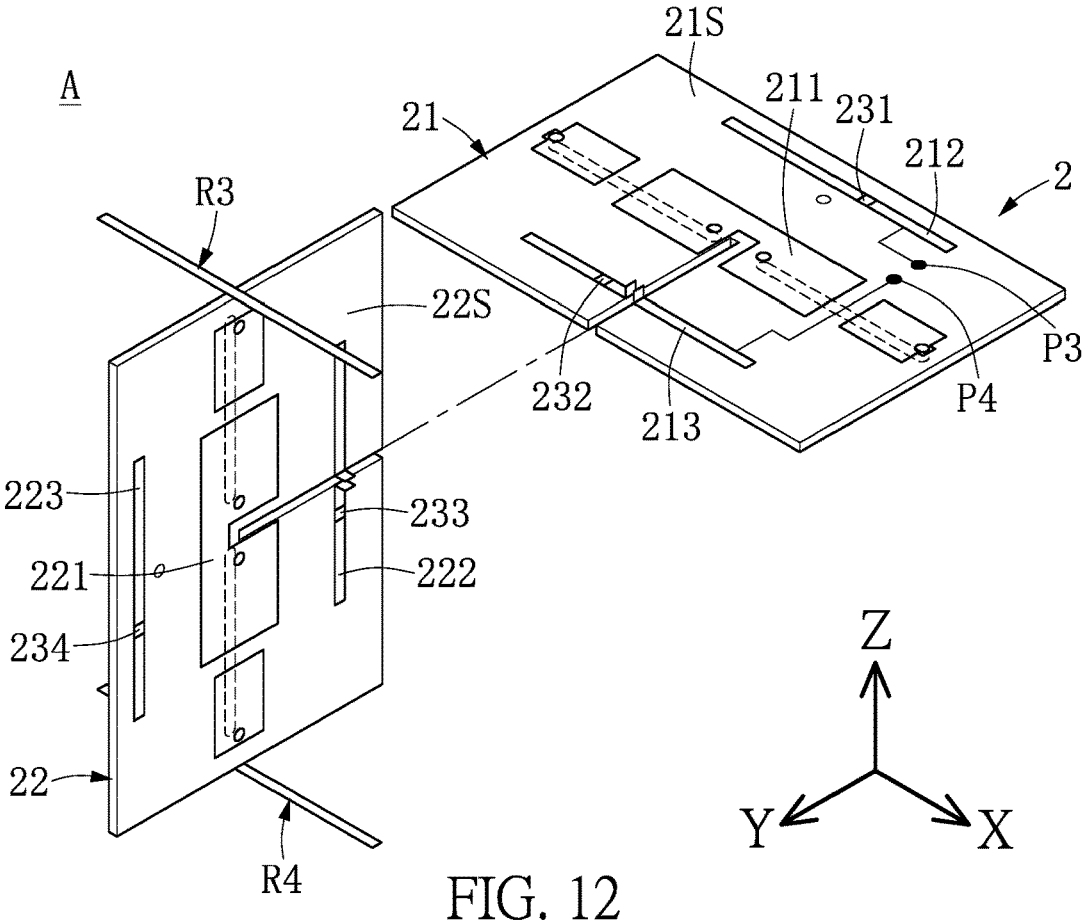
FIG. 12 is a perspective exploded view of the second smart antenna device of the smart antenna assembly according to one embodiment of the present disclosure.

Next, reference is made to FIG. 10 to FIG. 12. FIG. 10 is a schematic diagram of the second smart antenna device 2 of the smart antenna assembly A according to one embodiment of the present disclosure. FIG. 11 is a perspective assembled view of the second smart antenna device 2 of the smart antenna assembly A according to one embodiment of the present disclosure. FIG. 12 is a perspective exploded view of the second smart antenna device 2 of the smart antenna assembly A according to one embodiment of the present disclosure.

Referring again to FIG. 10 to FIG. 12, the second smart antenna device 2 can include a third polarization antenna 21, a fourth polarization antenna 22, a second switch unit 23, a third control terminal P3 and a fourth control terminal P4. The third polarization antenna 21 can include a third antenna 211, a fifth reflection element 212 disposed on a fifth side of the third antenna 211, and a sixth reflection element 213 disposed on a sixth side of the third antenna 211. The fourth polarization antenna 22 can include a fourth antenna 221, a seventh reflection element 222 disposed on a seventh side of the fourth antenna 221, and an eighth reflection element 223 disposed on an eighth side of the fourth antenna 221.

In certain embodiments, as described above, the third antenna 211 and the fourth antenna 221 can generate at least one operating frequency band or two operating frequency bands. Preferably, the smart antenna assembly A can further include a third substrate 21S and a fourth substrate 22S. The third polarization antenna 21 can be disposed on the third substrate 21S. The fourth polarization antenna 22 can be disposed on the fourth substrate 22S. The third substrate 21S and the fourth substrate 22S are substantially perpendicular to each other. However, in certain embodiments, a second predetermined included angle θ2 between the third substrate 21S and the fourth substrate 22S is between 80 degrees and 100 degrees. Nevertheless, the present disclosure is not limited thereto.

Referring again to FIG. 10 to FIG. 12, the second switch unit 23 can include a fifth switch element 231 electrically connected to the fifth reflection element 212, a sixth switch element 232 electrically connected to the sixth reflection element 213, a seventh switch element 233 electrically connected to the seventh reflection element 222, and an eighth switch element 234 electrically connected to the eighth reflection element 223. At least one of the fifth switch element 231 to the eighth switch element 234 can be a diode or a MOSFET. Further, the third control terminal P3 can be used to turn on the fifth switch element 231 and the seventh switch element 233, and the fourth control terminal P4 can be used to turn on the sixth switch element 232 and the eighth switch element 234. Further, one of the third control terminal P3 and the fourth control terminal P4 can output a second direct current signal.

Referring again to FIG. 10 to FIG. 12, in certain embodiments, the third control terminal P3 can be electrically connected to the fifth reflection element 212 and the seventh reflection element 222, and the fourth control terminal P4 can be electrically connected to the sixth reflection element 213 and the eighth reflection element 223. Thereby, the fifth reflection element 212 and the seventh reflection element 222 can be inputted with the second direct current signal at the same time, or the sixth reflection element 213 and the eighth reflection element 223 can be inputted with the second direct current signal at the same time. When the third control terminal P3 outputs the second direct current signal, the third control terminal P3 can be used to turn on the fifth switch element 231 and the seventh switch element 233. When the fourth control terminal P4 outputs the second direct current signal, the fourth control terminal P4 can be used to turn on the sixth switch element 232 and the eighth switch element 234. In this way, the fifth reflection element 212 and the seventh reflection element 222, or the sixth reflection element 213 and the eighth reflection element 223, can be selectively conducted at the same time, so as to control the radiation patterns of the third antenna 211 and the fourth antenna 221. In certain embodiments, when the fifth switch element 231 and the seventh switch element 233 are turned on by the third control terminal P3, and the switching circuit 4 selects either the third polarization antenna 21 or the fourth polarization antenna 22, the radiation pattern of the second smart antenna device 2 is one directing toward a third direction (the positive direction of the Y axis). When the sixth switch element 232 and the eighth switch element 234 are turned on by the fourth control terminal P4, and the switching circuit 4 selects either the third polarization antenna 21 or the fourth polarization antenna 22, the radiation pattern of the second smart antenna device 2 is one directing toward a fourth direction (the negative direction of the Y axis). In certain embodiments, the third direction and the fourth direction are opposite to each other. In addition, it is worth noting that the radiation patterns generated by the second smart antenna device 2, which direct toward the third direction and the fourth direction, are preferably different from the radiation patterns generated by the first smart antenna device 1, which direct toward the first direction and the second direction. That is, the first direction (for example, the negative direction of the X axis), the second direction (for example, the positive direction of the X axis), the third direction (for example, the positive direction of the Y axis) and the fourth direction (for example, the negative direction of the Y axis) are different from each other. In certain embodiments, the first direction and the second direction are substantially perpendicular to the third direction and the fourth direction. In addition, embodiments of each of the fifth, sixth, seventh and eighth switch elements 231-234 being a diode as described herein serve as examples for illustrative purpose only.

Referring again to FIGS. 10 to 12, the fifth reflection element 212 can include a ninth section 2121 and a tenth section 2122. The diode 231 can be electrically connected between the ninth section 2121 and the tenth section 2122. The sixth reflection element can include an eleventh section 2131 and a twelfth section 2132. The diode 232 can be electrically connected between the eleventh section 2131 and the twelfth section 2132. The seventh reflection element 222 can include a thirteenth section 2221 and a fourteenth section 2222. The diode 233 can be electrically connected between the thirteenth section 2221 and the fourteenth section 2222. The eighth reflection element 223 can include a fifteenth section 2231 and a sixteenth section 2232. The diode 234 can be electrically connected between the fifteenth section 2231 and the sixteenth section 2232. The third control terminal P3 can be electrically connected to the ninth section 2121 of the fifth reflection element 212. The ninth section 2121 of the fifth reflection element 212 can be electrically connected to the anode of the diode 231. The cathode of the diode 231 can be electrically connected to the tenth section 2122 of the fifth reflection element 212. The ninth section 2121 of the fifth reflection element 212 is electrically connected to the thirteenth section 2221 of the seventh reflection element 222. The thirteenth section 2221 of the seventh reflection element 222 is electrically connected to the anode of the diode 233. The cathode of the diode 133 is electrically connected to the fourteenth section 2222 of the seventh reflection element 222. The fourth control terminal P4 is electrically connected to the eleventh section 2131 of the sixth reflection element 213. The eleventh section 2131 of the sixth reflection element 213 is electrically connected to the anode of the diode 232. The cathode of the diode 232 is electrically connected to the twelfth section 2132 of the sixth reflection element 213. The eleventh section 2131 of the sixth reflection element 213 is electrically connected to the fifteenth section 2231 of the eighth reflection element 223. The fifteenth section 2231 of the eighth reflection element 223 is electrically connected to the anode of the diode 234. The cathode of the diode 234 is electrically connected to the sixteenth section 2232 of the eighth reflection element 223.

Further, as shown in FIG. 10, the third antenna 211 can further include a fifth radiating portion 2111, a sixth radiating portion 2112, and a third feeding element 2113 for receiving a third radio frequency signal. The third feeding element 2113 can have a third signal feeding terminal F5 and a third ground terminal F6. The third signal feeding terminal F5 can be electrically connected to the fifth radiating portion 2111. The third ground terminal F6 can be electrically connected to the sixth radiating portion 2112. The sixth radiating portion 2112 is electrically connected to the tenth section 2122 of the fifth reflection element 212 and the twelfth section 2132 of the sixth reflection element 213. The fourth antenna 221 can further include a seventh radiating portion 2211, an eighth radiating portion 2212, and a fourth feeding element 2213 for receiving a fourth radio frequency signal. The fourth feeding element 2213 can have a fourth signal feeding terminal F7 and a fourth ground terminal F8. The fourth signal feeding terminal F7 can be electrically connected to the seventh radiating portion 2211. The fourth ground terminal F8 can be electrically connected to the eighth radiating portion 2212. The eighth radiating portion 2212 is electrically connected to the fourteenth section 2222 of the seventh reflection element 222 and the sixteenth section 2232 of the eighth reflection element 223. In addition, in FIG. 10, an alternative symbol is used to represent the structure of the coaxial cable, so as to indicate the electrical connection configuration of the signal transmission. However, the present disclosure is not limited thereto.

In certain embodiments, as shown in FIG. 10, the second smart antenna device 2 can also include a fifth radio frequency choke unit 24, a sixth radio frequency choke unit 25, a seventh radio frequency choke unit 26 and an eighth radio frequency choke unit 27. The functions and effects of such are similar to the afore-mentioned first radio frequency choke unit 14, second radio frequency choke unit 15, third radio frequency choke unit 16 and fourth radio frequency choke unit 17, and therefore are not described herein. It should be noted that although a schematic diagram of the second smart antenna device 2 being implemented on a substrate is not shown in the drawings, such an implementation can be similar to that shown in FIG. 2, differing only in element labels.

Referring again to FIGS. 11 and 12, it is worth noting that the smart antenna assembly A can further include a third reflection structure R3 and a fourth reflection structure R4. The third reflection structure R3 can be disposed on one side (for example, an upper side) of the fourth antenna 221, and the fourth reflection structure R4 can be disposed on the other side (for example, the lower side) of the fourth antenna 221. In this way, the gain of the second smart antenna device 2 of the smart antenna assembly A can be adjusted, and a radiation pattern can be compressed.

Next, referring to FIG. 13, which is a schematic perspective view of a first smart antenna device 1 and a second smart antenna device 2 arranged adjacent to each other according to an embodiment of the present disclosure. In this way, by adopting the first smart antenna device 1 together with the second smart antenna device 2, the smart antenna assembly A can generate a radiation pattern in a first direction (for example, the negative direction of the X axis), second direction (for example, the positive direction of the X axis), a third direction (for example, the positive direction of the Y axis) and a fourth direction (for example, the negative direction of the Y axis).

For example, the first substrate 11S is arranged substantially parallel to the third substrate 21S, and the second substrate 12S and the fourth substrate 22S are arranged substantially perpendicular to each other. In certain embodiments, preferably, the first substrate 11S and the third substrate 21S can be disposed on the same plane, that is, the first polarization antenna 11 and the third polarization antenna 21 are coplanar. In certain embodiments, the distance from a center of symmetry of the first smart antenna device 1 to a center of symmetry of the second smart antenna device 2 can be defined as an electrical length. The electrical length equals to a wavelength of the lowest operating frequency in the operating frequency band where the smart antenna assembly A operates.

Further, through the arrangement of the substrates discussed above, the polarization direction of the first polarization antenna 11 and the polarization direction of the second polarization antenna 12 are substantially orthogonal to each other, and the polarization direction of the third polarization antenna 21 and the polarization direction of the fourth polarization antenna 22 are substantially orthogonal to each other. In certain embodiments, the polarization direction of the first polarization antenna 11 and the polarization direction of the third polarization antenna 21 are substantially the same, and the polarization direction of the second polarization antenna 12 and the polarization direction of the fourth polarization antenna 22 are substantially the same. In other words, in certain embodiments, the first polarization antenna 11 and the third polarization antenna 21 can be horizontal polarization antennas, and the second polarization antenna 12 and the fourth polarization antenna 22 can be vertical polarization antennas.

Figure 14:
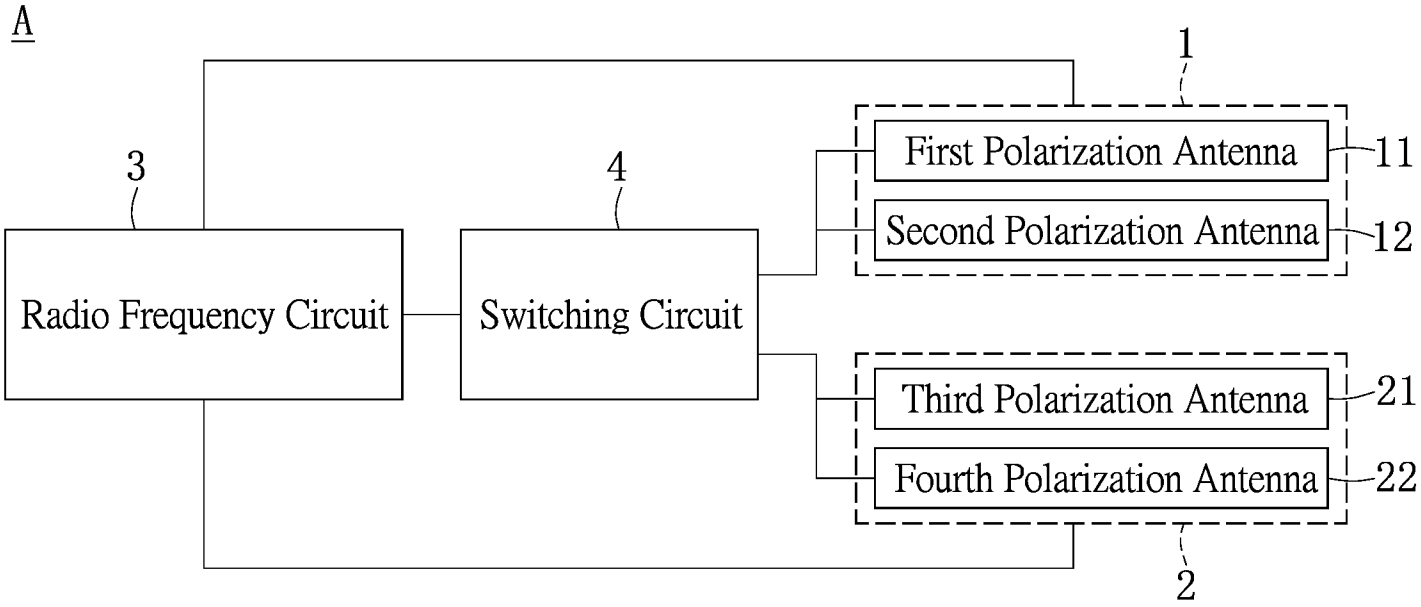
FIG. 14 is a functional block diagram of the smart antenna assembly according to an embodiment of the present disclosure.

Next, reference is made to FIG. 14, which is a functional block diagram of a smart antenna assembly A according to an embodiment of the present disclosure. Preferably, in certain embodiments, the smart antenna assembly A can further include a radio frequency circuit 3 and a switching circuit 4. The radio frequency circuit 3 can be electrically connected to the switching circuit 4 to transmit a control signal to the switching circuit 4. The switching circuit 4 can be electrically connected to the first polarization antenna 11, the second polarization antenna 12, the third polarization antenna 21 and the fourth polarization antenna 22. The switching circuit 4 can select one of the first polarization antenna 11 and the second polarization antenna 12 according to the control signal to transmit a first radio frequency signal to the first polarization antenna 11, or to transmit a second radio frequency signal to second polarization antenna 12. Further, the switching circuit 4 can select one of the third polarization antenna 21 and the fourth polarization antenna 22 according to the control signal, so as to transmit a third radio frequency signal to the third polarization antenna 21, or to transmit a fourth radio frequency signal to the fourth polarization antenna 22. Further, the radio frequency circuit 3 can be electrically connected to the first smart antenna device 1 to transmit the first direct current signal to one of the first control terminal P1 and the second control terminal P2. The radio frequency circuit 3 can also be electrically connected to the second smart antenna device 2 to transmit the second direct current signal to one of the third control terminal P3 and the fourth control terminal P4.

Figure 15A:
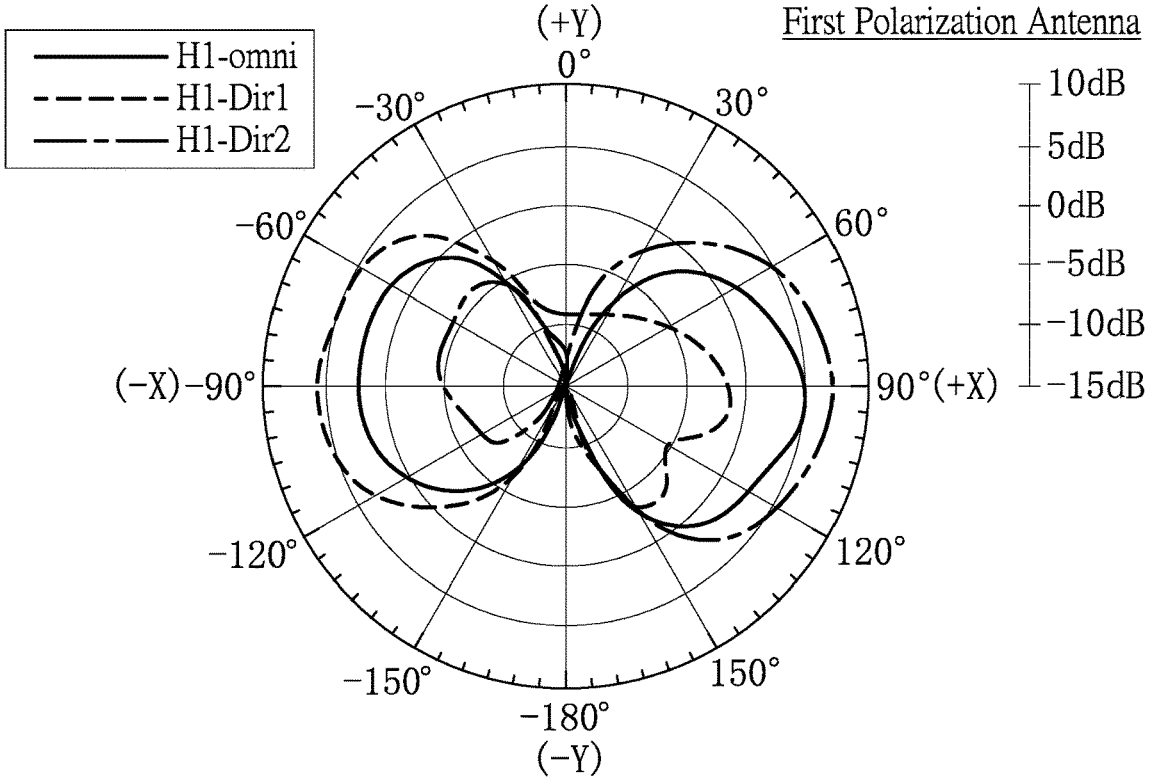
FIG. 15A is a schematic radiation pattern diagram of the first polarization antenna.
Figure 15B:
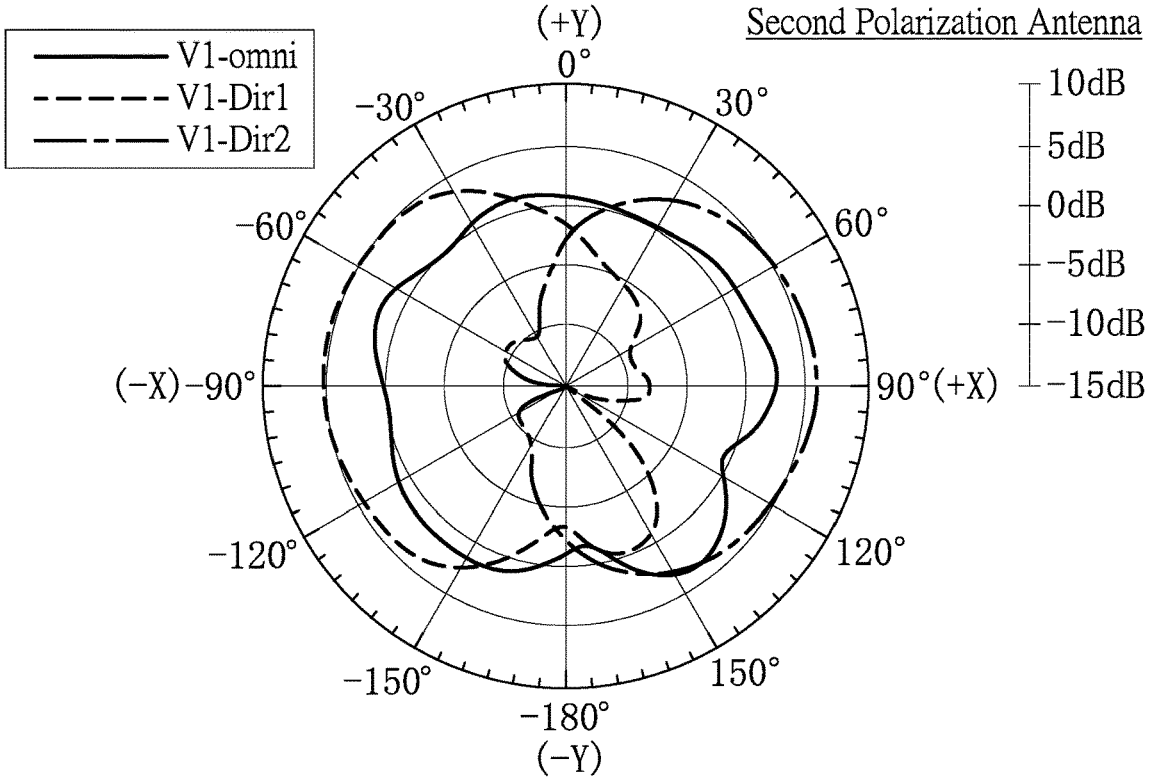
FIG. 15B is a schematic radiation pattern diagram of the second polarization antenna.
Figure 16A:
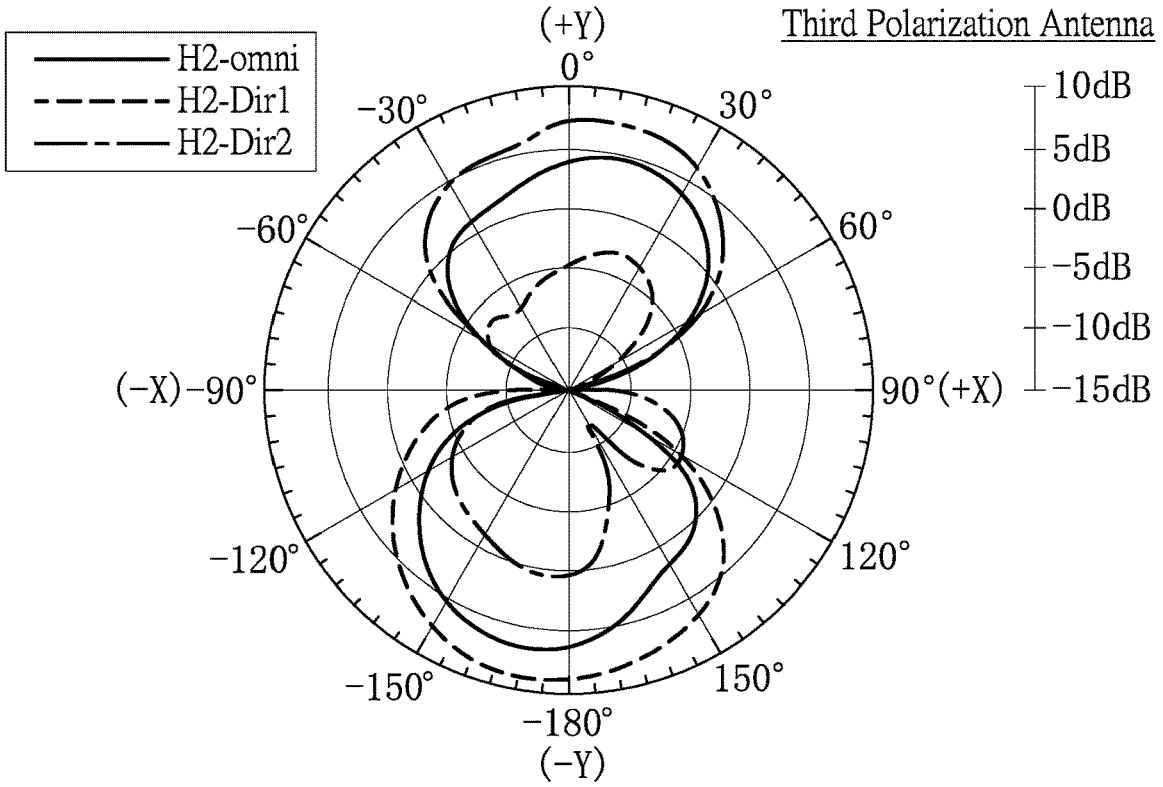
FIG. 16A is a schematic radiation pattern diagram of the third polarization antenna.
Figure 16B:
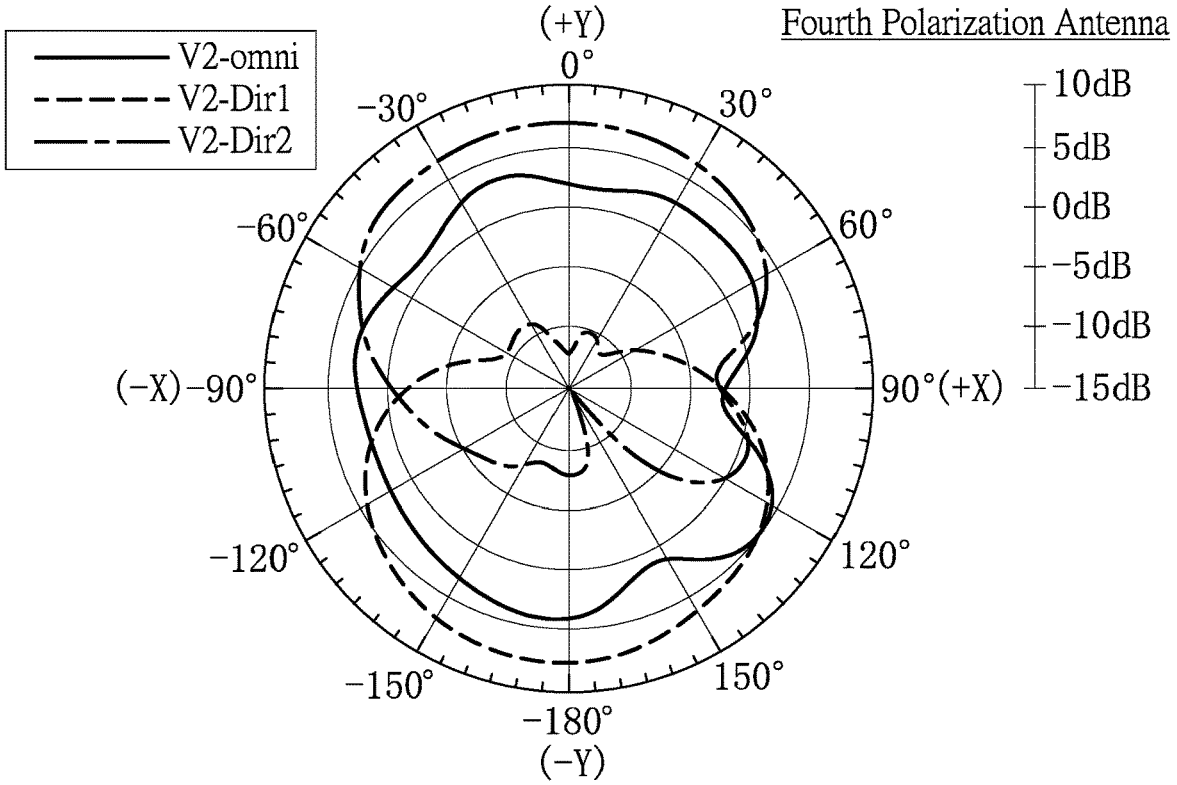
FIG. 16B is a schematic radiation pattern diagram of the fourth polarization antenna.

In addition, it is worth noting that, in certain embodiments, when the third antenna 211 and the fourth antenna 221 of the second smart antenna device 2 have at least two operating frequency bands, the smart antenna assembly A can further include a diplexer (not shown in the figure). The diplexer can be electrically connected between the switching circuit 4 and the first and second smart antenna devices 1 and 2. The diplexer can be used to switch between the operating frequency band of the first smart antenna device 1 and the operating frequency band of the second smart antenna device 2 according to the control signal. Thereby, at first, the radio frequency circuit 3 can provide a control signal, the switching circuit 4 can select the direction of polarization, and the diplexer can then activate the first smart antenna device 1 and the second smart antenna device 2 according to the control signal. And then, the direction of the radiation pattern of the smart antenna assembly A can be selected based on the inputting of the first direct current signal and the second direct current signal. Next, reference is made again to FIGS. 1, 10, 13 and 14, and is further made to FIG. 15A to FIG. 16B. FIG. 15A is a schematic radiation pattern diagram of the first polarization antenna 11. FIG. 15B is a schematic radiation pattern diagram of the second polarization antenna 12. FIG. 16A is a schematic radiation pattern diagram of the third polarization antenna 21. FIG. 16B is a schematic radiation pattern diagram of the fourth polarization antenna 22. When none of the first to fourth switch elements 131 to 134 is conducting, the switching circuit 4 can select one of the first polarization antenna 11 and the second polarization antenna 12 according to the control signal from the radio frequency circuit 3, so as to transmit a first radio frequency signal to the first polarization antenna 11 or to transmit a second radio frequency signal to the second polarization antenna 12. The radiation pattern of one of the first polarization antenna 11 and the second polarization antenna 12 is an omnidirectional radiation. For example, as shown in FIGS. 15A and 15B, the first polarization antenna 11 can generate an omnidirectional radiation pattern as delineated by the H1-omni line, and the second polarization antenna 12 can generate an omnidirectional radiation pattern as delineated by the V1-omni line.

Further, referring again to FIGS. 1, 10 and 13-16B, when the first switch element 131 and the third switch element 133 are turned on by the first control terminal P1 to be conducted, and the switching circuit 4 selects one of the first polarization antenna 11 and the second polarization antenna 12, the radiation pattern of the first smart antenna device 1 can be one directing toward a first direction (for example, the negative direction of the X axis). For example, as shown in FIGS. 15A and 15B, the first polarization antenna 11 can produce a radiation pattern as delineated by the H1-Dir1 line, and the second polarization antenna 12 can produce a radiation pattern as delineated by the V1-Dir1 line. Further, when the second switch element 132 and the fourth switch element 133 are turned on by the second control terminal P2 to be conducted, and the switching circuit 4 selects one of the first polarization antenna 11 and the second polarization antenna 12, the radiation pattern of the first smart antenna device 1 can be one directing toward a second direction (for example, the positive direction of the X axis). For example, as shown in FIGS. 15A and 15B, the first polarization antenna 11 can produce a radiation pattern as delineated by the H1-Dir2 line, and the second polarization antenna 12 can produce a radiation pattern as delineated by the V1-Dir2 line.

Further, reference is made again to FIGS. 1, 10 and 13-16B. When none of the fifth switch element 231, sixth switch element 232, seventh switch element 233 and eighth switch element 234 is turned on to be conducted, the switching circuit 4 can select one of the third polarization antenna 21 and the fourth polarization antenna 22 according to the control signal from the radio frequency circuit 3, so as to transmit a third radio frequency signal to the third polarization antenna 21 or to transmit a fourth radio frequency signal to the fourth polarization antenna 22. The radiation pattern of one of the first polarization antenna 11 and the second polarization antenna 12 is an omnidirectional radiation. For example, as shown in FIGS. 16A and 16B, the third polarization antenna 21 can generate an omnidirectional radiation pattern as delineated by the H2-omni line, and the fourth polarization antenna 22 can generate an omnidirectional radiation pattern as delineated by the V2-omni line.

Further, referring again to FIGS. 1, 10 and 13-16B, when the fifth switch element 231 and the seventh switch element 233 are turned on by the third control terminal P3 to be conducted, and the switching circuit 4 selects one of the third polarization antenna 21 and the fourth polarization antenna 22, the radiation pattern of the second smart antenna device 2 can be one directing toward a third direction (for example, the positive direction of the Y axis). For example, as shown in FIGS. 16A and 16B, the third polarization antenna 21 can produce a radiation pattern as delineated by the H2-Dir1 line, and the fourth polarization antenna 22 can produce a radiation pattern as delineated by the V2-Dir1 line. Further, when the sixth switch element 232 and the eighth switch element 234 are turned on by the fourth control terminal P4, and the switching circuit 4 selects one of the third polarization antenna 21 and the fourth polarization antenna 22, the radiation pattern of the second smart antenna device 2 can be one directing toward a fourth direction (for example, the negative direction of the Y axis). For example, as shown in FIGS. 16A and 16B, the third polarization antenna 21 can produce a radiation pattern shown in H2-Dir2 line, and the fourth polarization antenna 22 can produce a radiation pattern shown in V2-Dir2 line.

Thereby, based on the radiation pattern diagrams in FIGS. 15A to 16B, it can be derived that by adopting the first smart antenna device 1 together with the second smart antenna device 2, not only a polarization direction of the smart antenna assembly A can be selected, but also four radiation patterns, each having a direction different from the directions of other radiation patterns, can be produced. In other words, in certain embodiments, the first smart antenna device 1 can produce a horizontal polarization direction, and the second smart antenna device 2 can produce a vertical polarization direction. In certain embodiments, the first smart antenna device 1 can produce a vertical polarization direction, and the second smart antenna device 2 can produce a horizontal polarization direction. In certain embodiments, the first smart antenna device 1 can produce a horizontal polarization direction, and the second smart antenna device 2 can produce a horizontal polarization direction. In certain embodiments, the first smart antenna device 1 can produce a vertical polarization direction, and the second smart antenna device 2 can produce a vertical polarization direction. In addition, the radiation pattern of the smart antenna assembly A can also be adjusted to be one directing to the first direction (for example, the negative direction of the X axis), the second direction (for example, the positive direction of the X axis), the third direction (for example, the positive direction of the Y axis), or the fourth direction (for example, the negative direction of the Y axis) according to needs.

Further, referring again to FIG. 15A and FIG. 16A, when the first smart antenna device 1 selects the first polarization antenna 11 (for example, a horizontal polarization antenna), and the second smart antenna device 2 selects the third antenna 21 (for example, a horizontal polarization antenna), radiation patterns having similar pattern shape and directing to four different directions (the first, second, third and fourth directions) can be produced according to the outputting of direct current signals from the first to fourth control terminals P1 to P4. Thereby, when a user's device transmits and receives signals in the first to fourth directions, the user can have the same user experience. In addition, referring to FIG. 15B and FIG. 16B, when the first smart antenna device 1 selects the second polarization antenna 12 (for example, a vertical polarization antenna), and the second smart antenna device 2 selects the fourth polarization antenna 22 (for example, a vertical polarization antenna), radiation patterns having similar pattern shape and directing to four different directions (the first, second, third and fourth directions) can be produced according to the outputting of direct current signals from the first to fourth control terminals P1 to P4. In other words, the smart antenna assembly A provided by the present disclosure can not only generate four different radiation patterns in the same polarization direction, but also generate different radiation patterns in different polarization directions.

One of the beneficial effects of the present disclosure is that, through the technical features of "the first control terminal P1 is used to turn on the first switch element 131 and the third switch element 133, and the second control terminal P2 is used to turn on the second switch element 132 and the fourth switch element 134," the smart antenna assembly A can change its radiation pattern. That is, the first control terminal P1 and the second control terminal P2 can be used to adjust two different radiation patterns of the smart antenna assembly A. Therefore, the smart antenna assembly A provided by the present disclosure is an antenna structure having at least one omnidirectional radiation and two directional radiations.

Further, through the technical feature of "the switching circuit 4 selects one of the first polarization antenna 11 and the second polarization antenna 12 based on a control signal, so as to transmit a first radio frequency signal to the first polarization antenna 11, or to transmit a second radio frequency signal to the second polarization antenna 12," the smart antenna assembly A provided by the present disclosure can switch its polarization direction. That is, it can select a horizontal polarization antenna or a vertical polarization antenna based on practical requirement, and thereby has Multi-input Multi-output (MIMO) properties.

Furthermore, by adopting a second smart antenna device 2, the smart antenna assembly A provided by the present disclosure can produce four radiation patterns having different directions. Also, by adopting a switching circuit 4, a polarization direction of the smart antenna assembly A can be switched. That is, in certain embodiments, a polarization direction of the smart antenna assembly A can be selected first, and then the direction of the radiation pattern of the smart antenna assembly A is selected based on needs, so as to cover all the radiation directions.

Moreover, since the first polarization antenna 11 is disposed on the first substrate 11S, and the second polarization antenna 12 is disposed on the second substrate 12S, the smart antenna assembly A provided by the present disclosure can be disposed at any position deemed necessary according to practical requirements. In other words, by arranging the first switch element 131, second switch element 132, third switch element 133, fourth switch element 134, first control terminal P1 and second control terminal P2 on the first substrate 11S and the second substrate 12S, and using the feeding lines of the first coaxial cable 1113' and the second coaxial cable 1213', the smart antenna assembly A can be easily disposed at any position deemed necessary or possible according to practical requirements, thereby increasing product design flexibility and use flexibility.

The foregoing description of the exemplary embodiments of the present disclosure has been presented only for the purposes of illustration and description and is not intended to be exhaustive or to limit the present disclosure to the precise forms disclosed. Many modifications and variations are possible in light of the above teaching.

The embodiments were selected and described in order to explain the principles of the present disclosure and their practical application so as to enable others skilled in the art to utilize the present disclosure and various embodiments and with various modifications as are suited to the particular use contemplated. Alternative embodiments will become apparent to those skilled in the art to which the present disclosure pertains without departing from its spirit and scope.

What is claimed is:

1. An antenna assembly, comprising:

a first antenna device including:

a first substrate;

a second substrate, substantially perpendicular to the second substrate;

a first polarization antenna disposed on the first substrate, including:

a first antenna;

a first reflection element disposed on a first side of the first antenna; and a second reflection element disposed on a second side of the first antenna;

a second polarization antenna disposed on the second substrate, including:

a second antenna;

a third reflection element disposed on a third side of the second antenna; and a fourth reflection element disposed on a fourth side of the second antenna;

a first switch unit, including:

a first switch element electrically connected to the first reflection element;

a second switch element electrically connected to the second reflection element;

a third switch element electrically connected to the third reflection element; and a fourth switch element electrically connected to the fourth reflection element;

a first control terminal for turning on the first switch element and the third switch element; and a second control terminal for turning on the second switch element and the fourth switch element.

2. The antenna assembly according to claim 1, wherein the first reflection element includes a first section and a second section, and the first switch element is electrically connected between the first section and the second section;

wherein the second reflection element includes a third section and a fourth section, and the second switch element is electrically connected between the third section and the fourth section;

wherein the third reflection element includes a fifth section and a sixth section, and the third switch element is electrically connected between the fifth section and the sixth section;

wherein the fourth reflection element includes a seventh section and an eighth section, and the fourth switch element is electrically connected between the seventh section and the eighth section;

wherein the first control terminal is electrically connected to the first section of the first reflection element, the first section of the first reflection element is electrically connected to an anode of the first switch element, a cathode of the first switch element is electrically connected to the second section of the first reflection element, the first section of the first reflection element is electrically connected to the fifth section of the third reflection element, the fifth section of the third reflection element is electrically connected to an anode of the third switch element, and a cathode of the third switch element is electrically connected to the sixth section of the third reflection element; and wherein the second control terminal is electrically connected to the third section of the second reflection element, the third section of the second reflection element is electrically connected to an anode of the second switch element, a cathode of the second switch element is electrically connected to the fourth section of the second reflection element, the third section of the second reflection element is electrically connected to the seventh section of the fourth reflection element, the seventh section of the fourth reflection element is electrically connected to an anode of the fourth switch element, and a cathode of the fourth switch element is electrically connected to the eighth section of the fourth reflection element.

3. The antenna assembly according to claim 2, wherein the first antenna further includes:

a first radiating portion;

a second radiating portion, electrically connected to the second section of the first reflection element and the fourth section of the second reflection element; and a first feeding element, configured to receive a first radio frequency signal and disposed between the first radiating portion and the second radiating portion; and wherein the second antenna further includes:

a third radiating portion;

a fourth radiating portion, electrically connected to the sixth section of the third reflection element and the eighth section of the fourth reflection element; and a second feeding element, configured to receive a second radio frequency signal and disposed between the third radiating portion and the fourth radiating portion.

4. The antenna assembly according to claim 1, further comprising a second antenna device including:

a third polarization antenna, including:

a third antenna;

a fifth reflection element disposed on a fifth side of the third antenna; and a sixth reflection element disposed on a sixth side of the third antenna;

a fourth polarization antenna, including:

a fourth antenna;

a seventh reflection element disposed on a seventh side of the fourth antenna; and an eighth reflection element disposed on an eighth side of the fourth antenna;

a second switch unit, including:

a fifth switch element electrically connected to the fifth reflection element;

a sixth switch element electrically connected to the sixth reflection element;

a seventh switch element electrically connected to the seventh reflection element; and an eighth switch element electrically connected to the eighth reflection element;

a third control terminal for turning on the fifth switch element and the seventh switch element; and a fourth control terminal for turning on the sixth switch element and the eighth switch element.

5. The antenna assembly according to claim 4, wherein one of the first control terminal and the second control terminal is configured to output a first direct current signal, and one of the third control terminal and the fourth control terminal is configured to output a second direct current signal.

6. The antenna assembly according to claim 5, further comprising:

a radio frequency circuit; and a switching circuit, electrically connected to the radio frequency circuit and configured to transmit a control signal;

wherein the switching circuit is electrically connected to the first polarization antenna, the second polarization antenna, the third polarization antenna and the fourth polarization antenna, and is configured to:

receive the control signal from the radio frequency circuit;

select one of the first polarization antenna and the second polarization antenna according to the control signal;

in response to selecting the first polarization antenna, transmit a first radio frequency signal to the first polarization antenna;

in response to selecting the second polarization antenna, transmit a second radio frequency signal to the second polarization antenna;

select one of the third polarization antenna and the fourth polarization antenna according to the control signal;

in response to selecting the third polarization antenna, transmit a third radio frequency signal to the third polarization antenna; and in response to selecting the fourth polarization antenna, transmit a fourth radio frequency signal to the fourth polarization antenna.

7. The antenna assembly according to claim 4, further comprising a a third substrate and a fourth substrate, wherein the third polarization antenna is disposed on the third substrate, and the fourth polarization antenna is disposed on the fourth substrate; and wherein the third substrate is substantially perpendicular to the fourth substrate, the first substrate is substantially parallel to the third substrate, and the second substrate is substantially perpendicular to the fourth substrate.

8. The antenna assembly according to claim 4, wherein a polarization direction of the first polarization antenna is substantially orthogonal to a polarization direction of the second polarization antenna, and a polarization direction of the third polarization antenna is substantially orthogonal to a polarization direction of the fourth polarization antenna; and wherein the polarization direction of the first polarization antenna is substantially the same as the polarization direction of the third polarization antenna, and the polarization direction of the second polarization antenna is substantially the same as the polarization direction of the fourth polarization antenna.

9. The antenna assembly according to claim 4, wherein a distance from a center of symmetry of the first antenna device to a center of symmetry of the second antenna device is defined as an electrical length, and the electrical length equals to a wavelength of a lowest operating frequency in an operating frequency band where the antenna assembly operates.

10. The antenna assembly according to claim 4, wherein in response to the first switch element and the third switch element being turned on by the first control terminal and the switching circuit selecting one of the first polarization antenna and the second polarization antenna, a radiation pattern of the first antenna device directs to a first direction;

wherein in response to the second switch element and the fourth switch element being turned on by the second control terminal and the switching circuit selecting one of the first polarization antenna and the second polarization antenna, the radiation pattern of the first antenna device directs to a second direction;

wherein in response to the fifth switch element and the seventh switch element being turned on by the third control terminal and the switching circuit selecting one of the third polarization antenna and the fourth polarization antenna, a radiation pattern of the second antenna device directs to a third direction; and wherein in response to the sixth switch element and the eighth switch element being turned on by the fourth control terminal and the switching circuit selecting one of the third polarization antenna and the fourth polarization antenna, the radiation pattern of the second antenna device directs to a fourth direction, and the first direction, the second direction, the third direction and the fourth direction are different from each other.

11. The antenna assembly according to claim 1, wherein the first polarization antenna is configured to operate in a first operating frequency band and a second operating frequency band, the second polarization antenna is configured to operate in a third operating frequency band and a fourth operating frequency band, a center frequency of the first operating frequency band is higher than a center frequency of the second operating frequency band, and a center frequency of the third operating frequency band is higher than a center frequency of the fourth operating frequency band;

wherein a distance between the first reflection element and the first antenna is between one-eighth and one-fourth of a wavelength of the center frequency of the first operating frequency band, a distance between the second reflection element and the first antenna is between one-eighth and one-fourth of the wavelength of the center frequency of the first operating frequency band, a distance between the third reflection element and the second antenna is between one-eighth and one-fourth of a wavelength of the center frequency of the third operating frequency band, and a distance between the fourth reflection element and the second antenna is between one-eighth and one-fourth of the wavelength of the center frequency of the third operating frequency band.

* * * * *